US011264770B2

(12) United States Patent
Koide

(10) Patent No.: US 11,264,770 B2
(45) Date of Patent: Mar. 1, 2022

(54) METAL MOLD FOR CRIMPING AND CRIMPING DEVICE

(71) Applicant: Japan Aviation Electronics Industry, Limited, Tokyo (JP)

(72) Inventor: Kiyohito Koide, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 57 days.

(21) Appl. No.: 16/804,569

(22) Filed: Feb. 28, 2020

(65) Prior Publication Data

US 2020/0280157 A1 Sep. 3, 2020

(30) Foreign Application Priority Data

Mar. 1, 2019 (JP) ..... JP2019-037897

(51) Int. Cl.

| | |
|---|---|
| ***H01R 43/04*** | (2006.01) |
| ***H01R 43/048*** | (2006.01) |
| ***H01R 43/042*** | (2006.01) |
| ***H01R 43/058*** | (2006.01) |
| ***H01R 4/20*** | (2006.01) |

(52) U.S. Cl.

CPC ..... *H01R 43/048* (2013.01); *H01R 4/203* (2013.01); *H01R 43/042* (2013.01); *H01R 43/058* (2013.01)

(58) Field of Classification Search

CPC .. H01R 43/048; H01R 43/042; H01R 43/058; H01R 4/203; Y10T 29/49174; Y10T 29/53209; Y10T 29/53235; Y10T 29/5327

USPC ..... 29/747, 753, 761

See application file for complete search history.

(56) References Cited

U.S. PATENT DOCUMENTS

| | | | | |
|---|---|---|---|---|
| 1,858,418 A * | 5/1932 | Rowley | H01R 43/042 72/370.12 |
| 5,692,294 A * | 12/1997 | Casey | H01R 43/042 29/751 |
| 7,484,294 B2 * | 2/2009 | De Keyser | H01R 4/20 29/750 |
| 2014/0144011 A1 | 5/2014 | Sugimoto et al. | |

FOREIGN PATENT DOCUMENTS

JP 5686064 B2 3/2015

* cited by examiner

*Primary Examiner* — Donghai D Nguyen

(74) *Attorney, Agent, or Firm* — Muncy, Geissler, Olds & Lowe, P.C.

(57) ABSTRACT

A crimping die including a first die piece having a recess portion and a second die piece having a protrusion portion is provided. An inner wall surface of the recess portion has a bottom wall surface and recess-side lateral end surfaces. An outer surface of the protrusion portion has a top end surface and protrusion-side lateral end surfaces. The bottom wall surface has a recess-side projection portion, a recess-side concave portion, and a recess-side curvature changing portion. The top end surface has a protrusion-side projection portion, a protrusion-side concave portion, and a protrusion-side curvature changing portion. A sign of curvature of the bottom wall surface changes at a boundary portion in the recess-side curvature changing portion with respect to the recess-side concave portion. A sign of curvature of the top end surface changes at a boundary portion in the protrusion-side curvature changing portion with respect to the protrusion-side concave portion.

8 Claims, 18 Drawing Sheets

METAL MOLD FOR CRIMPING AND CRIMPING DEVICE

BACKGROUND OF THE INVENTION

The present invention relates to a crimping die, particularly to a crimping die used for crimping a tubular crimp portion of a terminal fitting onto a conductive wire lying in the crimp portion.

The present invention also relates to a crimping equipment having a crimping die.

The present invention also relates to a method of manufacturing a conductive wire with a terminal by means of a crimping die or a crimping equipment.

It is well known to manufacture a conductive wire with a terminal by inserting a conductive wire into a tubular crimp portion of a terminal fitting and crimping (i.e., swaging) the crimp portion onto the conductive wire by means of a crimping die. For such a crimp portion, a tubular crimp portion of so-called closed barrel type may be used. The crimp portion of this type is deformed under pressure (squashed) by means of a crimping die and thereby joined with a conductive wire lying in the crimp portion.

In terms of the outer shape (crimp shape) of a crimp portion after crimping, a dumbbell-like crimp shape (hereinafter also called "narrowed elliptical shape") in cross section shown in FIG. 33 leads to excellent crimp strength and excellent electric characteristics (e.g., a crimp resistance residual). A crimping die capable of forming the narrowed elliptical shape as the crimp shape has been developed to date, and one example thereof is a crimping die described in JP 5686064 B.

As shown in FIGS. 32 and 33, the crimping die (hereinafter called "conventional die 100") described in the above publication has a first die piece 103 and a second die piece 105, the first die piece 103 being provided with a recess surface 102 for constraining a crimp portion 101 of circular tube shape formed in a terminal fitting, and the second die piece 105 being provided with a protrusion surface 104 serving as a counterpart of the recess surface 102. This conventional die 100 sandwiches the crimp portion 101 between the recess surface 102 and the protrusion surface 104 to compress and deform the portion 101, thereby crimping and fixing the crimp portion 101 onto a conductive wire 106 lying in the crimp portion 101.

FIGS. 32 and 33 show cross sections of the conventional die 100 (precisely, cross sections with the depth direction being defined as a normal line direction), where FIG. 32 shows the state immediately before crimping, and FIG. 33 shows the state immediately after completion of the crimping.

As shown in FIG. 32, in the conventional die 100 above, a first projection portion 107 projects from the bottom portion of the recess surface 102. This first projection portion 107 extends along the depth direction of the first die piece 103. A second projection portion 108 projects from the top end portion of the protrusion surface 104. This second projection portion 108 extends along the depth direction of the second die piece 105. In the conventional die 100, the lateral width of the bottom portion of the recess surface 102 and that of the top end portion of the protrusion surface 104 coincide with the outer diameter of the crimp portion 101.

The conventional die 100 thus configured can compress and deform the crimp portion 101 into a narrowed elliptical shape. Further, at crimping, the conventional die 100 can squash the crimp portion 101 in a longitudinal direction (Z direction in FIG. 33) while keeping the lateral width of the crimp portion 101 unchanged.

As shown in FIGS. 32 and 33, however, in the conventional die 100, the bottom portion of the recess surface 102 and the top end portion of the protrusion surface 104 are different in shape from each other, so that the cross-sectional shape of the crimp portion 101 formed through crimping should be affected by the shape difference between the bottom portion and the top end portion. More specifically, the bottom portion of the recess surface 102 has curved surfaces 109 extending separately from the lateral sides of the first projection portion 107. Each curved surface 109 is curved in a concave form and smoothly connected to the corresponding lateral end portion of the recess surface 102. On the other hand, the top end portion of the protrusion surface 104 has curved surfaces 110 extending separately from the lateral sides of the second projection portion 108 toward the lateral ends of the protrusion surface 104. Each curved surface 110 is curved in a concave form and extends up to a position slightly anterior to the corresponding lateral end of the protrusion surface 104. The top end portion of the protrusion surface 104 sharply bends at intermediate positions (specifically, one end position of each of the curved surfaces 110) and forms flat surfaces 111 extending from the bending positions to the lateral ends of the protrusion surface 104, separately.

Due to the shape difference as described above, the crimp portion 101 is unsuitably deformed in the longitudinal direction at crimping, as shown in FIG. 33. More specifically, since the curved surfaces 109 provided on the lateral sides of the first projection portion 107 in the bottom portion of the recess surface 102 separately extend up to the lateral end portions of the recess surface 102, when the crimp portion 101 is pressed against the first projection portion 107 at crimping, the crimp portion 101 is deformed such that a material part of the crimp portion 101 is forced out from the contacting point toward the lateral sides (in the X direction in FIG. 33) along the curved surfaces 109. Consequently, the crimp portion 101 is unsuitably deformed in the longitudinal direction, and in particular, the portion of the crimp portion 101 pressed with the first projection portion 107 is decreased in thickness, whereby cracks or fractures may be easily generated.

SUMMARY OF THE INVENTION

The present invention has been made in view of the above circumstances and is aimed at solving objects described below.

An object of the invention is to solve the above problem of the conventional art by providing a crimping die capable of appropriately deforming a crimp portion into a narrowed elliptical shape, thus achieving an excellent crimp.

Another object of the invention is to provide a crimping equipment having a crimping die achieving the above object.

Another object of the invention is to provide a method of manufacturing a conductive wire with a terminal using the crimping die and the crimping equipment.

In order to attain the foregoing objects, the present invention provides a crimping die for use in crimping a crimp portion of tubular shape included in a terminal fitting onto a conductive wire lying in the crimp portion, comprising: a first die piece having a recess portion and a second die piece having a protrusion portion that enters the recess portion, wherein an inner wall surface of the recess portion has a bottom wall surface and a pair of recess-side lateral end surfaces separately situated on opposite sides of the bottom wall surface, an outer surface of the protrusion portion has a top end surface and a pair of protrusion-side lateral end surfaces separately situated on opposite sides of the top end surface, the crimping die presses the crimp portion having the conductive wire therein with the inner wall surface and the outer surface to crimp the crimp portion onto the conductive wire, the bottom wall surface has a recess-side projection portion projecting toward an opening of the recess portion, a recess-side concave portion adjoining the recess-side projection portion, and a recess-side curvature changing portion between the recess-side concave portion and one of the pair of recess-side lateral end surfaces, the top end surface has a protrusion-side projection portion projecting in a same direction as a direction in which the protrusion portion protrudes, a protrusion-side concave portion adjoining the protrusion-side projection portion, and a protrusion-side curvature changing portion between the protrusion-side concave portion and one of the pair of protrusion-side lateral end surfaces, a sign of curvature of the bottom wall surface changes at a boundary portion in the recess-side curvature changing portion with respect to the recess-side concave portion, and a sign of curvature of the top end surface changes at a boundary portion in the protrusion-side curvature changing portion with respect to the protrusion-side concave portion.

The present invention provides another crimping die for use in crimping a crimp portion of tubular shape included in a terminal fitting onto a conductive wire lying in the crimp portion, comprising: a first die piece having a recess portion and a second die piece having a protrusion portion that enters the recess portion, wherein an inner wall surface of the recess portion has a bottom wall surface and a pair of recess-side lateral end surfaces separately situated on opposite sides of the bottom wall surface, an outer surface of the protrusion portion has a top end surface and a pair of protrusion-side lateral end surfaces separately situated on opposite sides of the top end surface, the crimping die presses the crimp portion having the conductive wire therein with the inner wall surface and the outer surface to crimp the crimp portion onto the conductive wire, the bottom wall surface has a recess-side projection portion projecting toward an opening of the recess portion, a recess-side concave portion adjoining the recess-side projection portion, and a recess-side curvature changing portion between the recess-side concave portion and one of the pair of recess-side lateral end surfaces, the top end surface has a protrusion-side projection portion projecting in a same direction as a direction in which the protrusion portion protrudes, a protrusion-side concave portion adjoining the protrusion-side projection portion, and a protrusion-side curvature changing portion between the protrusion-side concave portion and one of the pair of protrusion-side lateral end surfaces, the recess-side curvature changing portion forms a flat surface intersecting one of the pair of recess-side lateral end surfaces, and the protrusion-side curvature changing portion forms a flat surface intersecting one of the pair of protrusion-side lateral end surfaces.

The present invention also provides a crimping equipment for crimping the crimp portion onto the conductive wire by means of one of the crimping dies described above.

The present invention also provides a method of manufacturing a conductive wire with a terminal by crimping the crimp portion onto the conductive wire by means of one of the crimping dies according to the invention or the crimping equipment according to the invention.

DETAILED DESCRIPTION OF THE INVENTION

A crimping die and a crimping equipment according to embodiments of the invention are described below with reference to the appended drawings. To clarify the positional relation and moving directions of members, three coordinate axes (X, Y and Z axes) intersecting one another are provided to the drawings referred to in the description below, as appropriate.

The embodiments described below are only examples used to facilitate the understanding of the invention, and the invention is by no means limited thereto. In other words, the invention may be modified or improved from the embodiments described below without departing from the scope and spirit of the invention. In particular, the materials, design dimensions and other factors of members used in the invention can be freely determined as long as the configuration of the invention is satisfied and the effects of the invention are produced. Needless to say, the invention includes its equivalents.

In the following description, the terms "same" and "coincide" include not only the completely same and coinciding cases but also the cases where things are different within an error range generally allowed in the technical field the invention pertains to. The same applies to the terms "symmetric" and "mirror image relationship" in the following description.

<Conductive Wire with Terminal>

Figure 1:
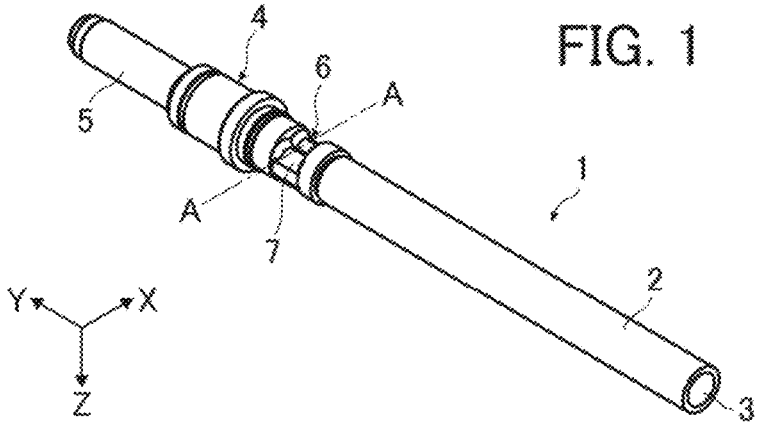
FIG. 1 is a perspective view of a conductive wire with a terminal.
Figure 2:
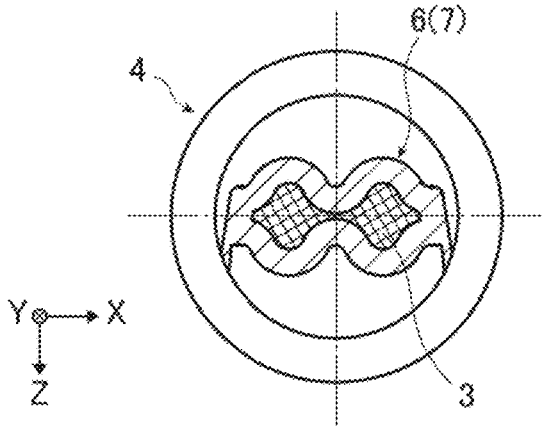
FIG. 2 is a cross-sectional view taken along line A-A in FIG. 1.
Figure 3:
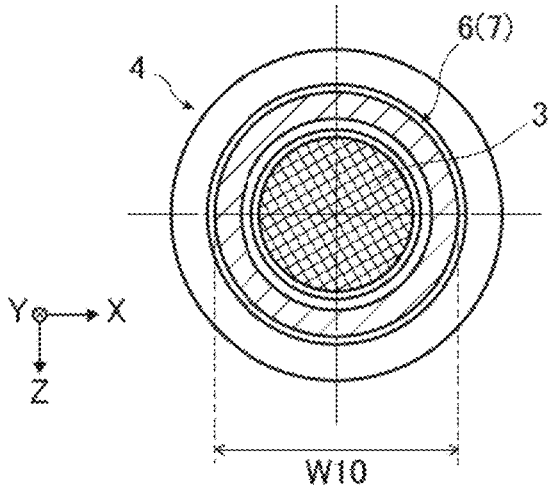
FIG. 3 is a cross-sectional view of a crimp portion the same as FIG. 2 but it is the state before crimping.

For describing a crimping die and a crimping equipment of the invention, the description is made on a conductive wire with a terminal that is manufactured using the crimping die and the crimping equipment of the invention with reference to FIGS. 1 to 3. FIG. 1 is a perspective view showing a conductive wire with a terminal 1 (terminal-attached conductive wire 1). FIG. 2 is a cross-sectional view taken along line A-A in FIG. 1, showing a cross section of a crimp part 7 to be described later. FIG. 3 is a cross-sectional view of the crimp part 7 that corresponds to FIG. 2 but shows the state before crimping.

In FIG. 1, the direction in which a conductor cable 2 of the terminal-attached conductive wire 1 extends is defined as "Y direction," and the side on which a terminal portion 5 of a terminal fitting 4 is present in the Y direction is defined as "+Y side," while the opposite side thereof is defined as "−Y side." In FIG. 2, in a cross section of the crimp part 7 having a narrowed elliptical shape, the direction corresponding to the major axis of the narrowed ellipse is defined as "X direction," while the direction corresponding to the minor axis thereof (i.e., a narrowed direction) is defined as "Z direction."

As shown in FIG. 1, the terminal-attached conductive wire 1 is composed of the conductor cable 2 and the terminal fitting 4 that is crimped on a plurality of conductive wires 3 bared at the tip of the conductor cable 2. The conductive wires 3 are disposed in the form of strand wire inside the conductor cable 2.

As shown in FIG. 1, the terminal fitting 4 has the terminal portion 5 of pin shape and a crimp portion 6 of circular tube shape (closed barrel type). The crimp portion 6 is disposed posterior to the terminal portion 5 (on the −Y side thereof), and the bared conductive wires 3 are disposed inside the crimp portion 6.

A portion (hereinafter called "crimp part 7") slightly anterior to the rear end (−Y side end) of the crimp portion 6 (on the +Y side of the rear end) is pressed with the crimping die of the invention and thereby compressed and deformed. Thus, the crimp part 7 that had a circular tube shape as shown in FIG. 3 before crimping is squashed into a narrowed elliptical shape as shown in FIG. 2, and consequently, the crimp portion 6 (precisely, the crimp part 7) is crimped on and joined with the conductive wires 3 lying in the crimp portion 6.

In this process, when the crimping die of the invention is used, the crimp part 7 after crimping has a substantially symmetric structure in the X direction and the Z direction as shown in FIG. 2. That is, the appearance when the terminal-attached conductive wire 1 is viewed from the +Z side and that when the terminal-attached conductive wire 1 is viewed from the −Z side are substantially the same. Owing to the crimping performed such that the crimp part 7 can have a symmetric structure as described above, the terminal-attached conductive wire 1 having excellent crimp strength and crimp resistance residual can be manufactured.

Figure 4:
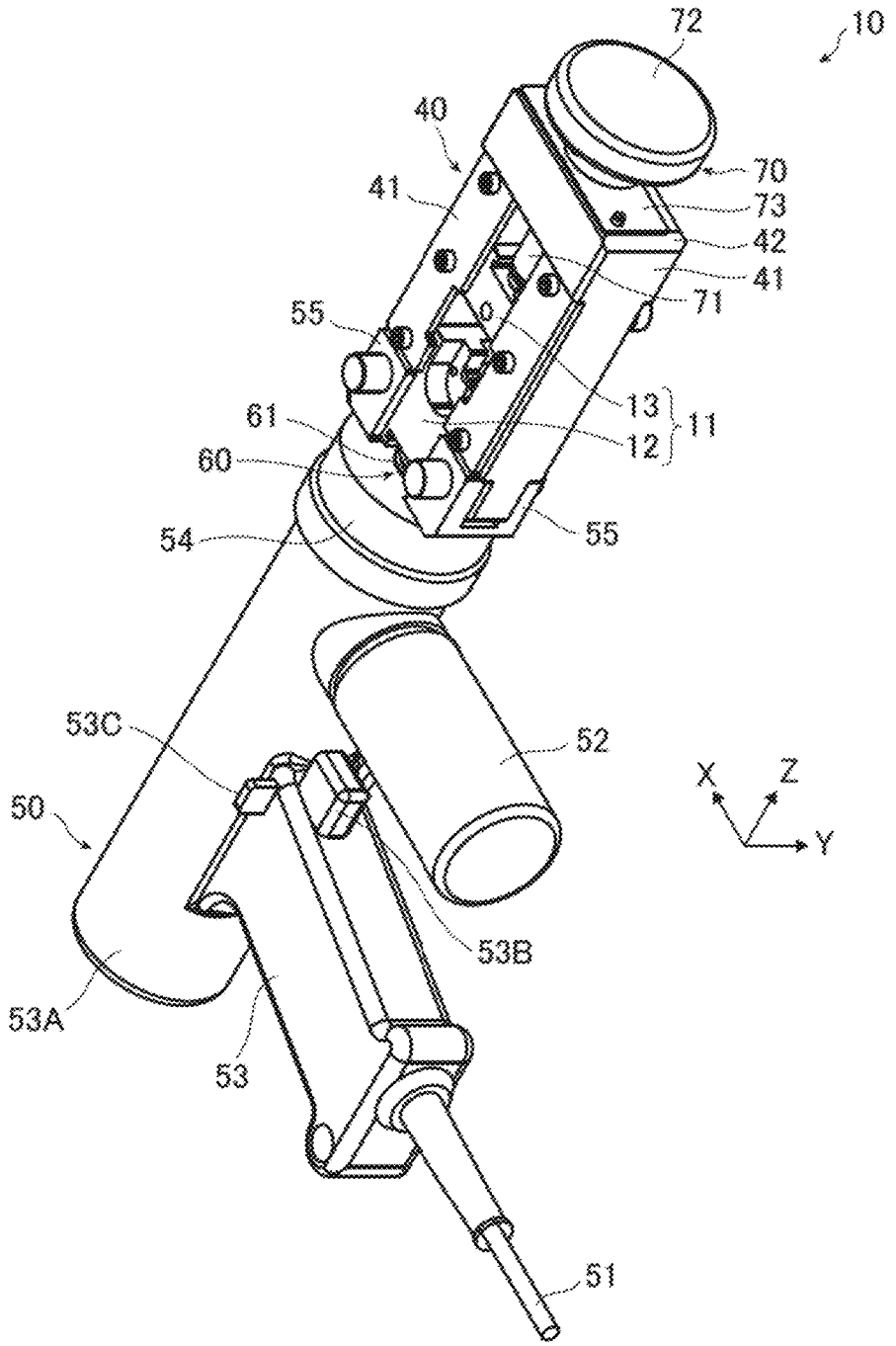
FIG. 4 is a perspective view showing the whole of a crimping equipment according to Embodiment 1 of the invention.
Figure 5:
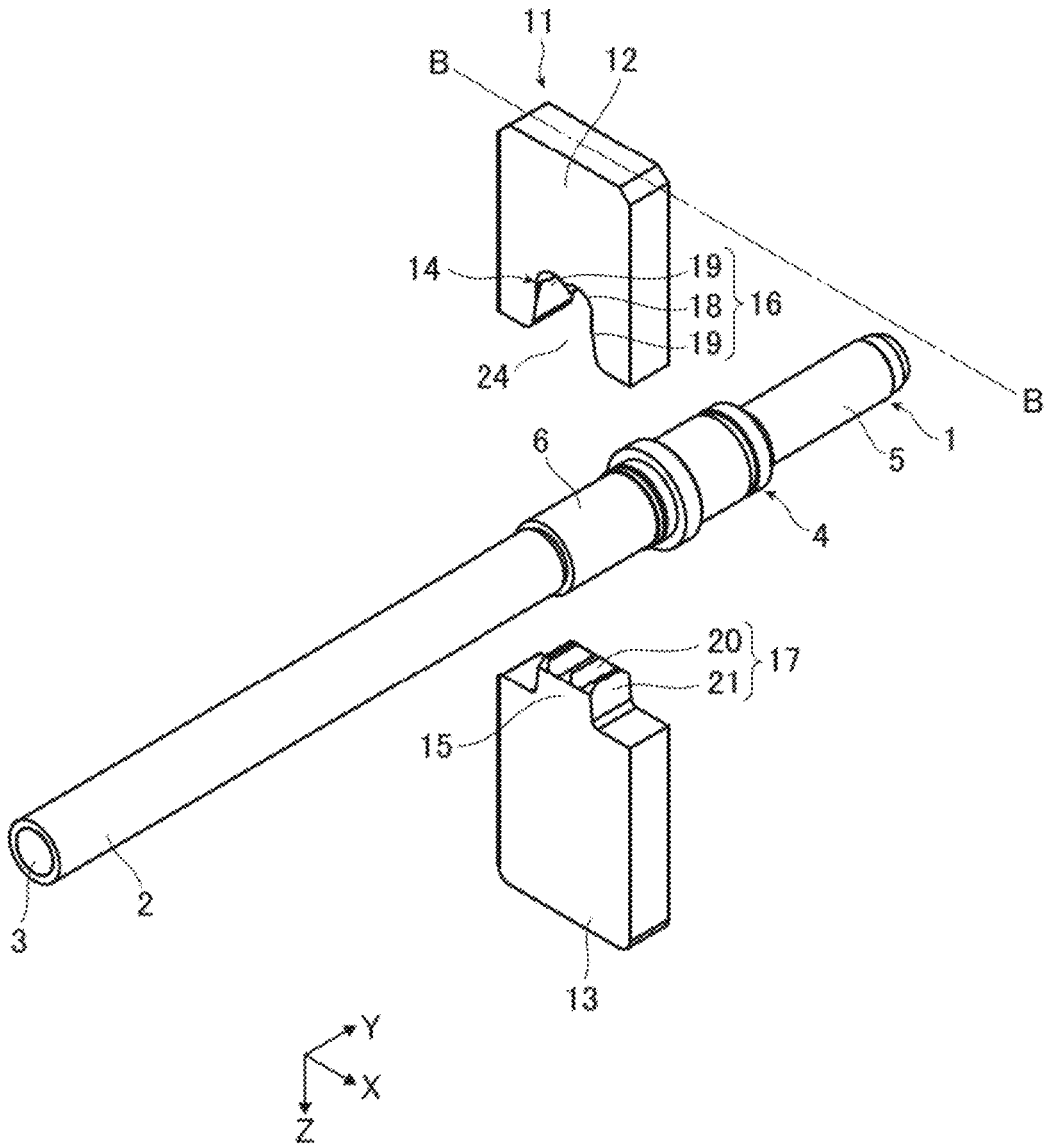
FIG. 5 is a perspective view showing a crimping die and the conductive wire with a terminal before crimping.
Figure 6:
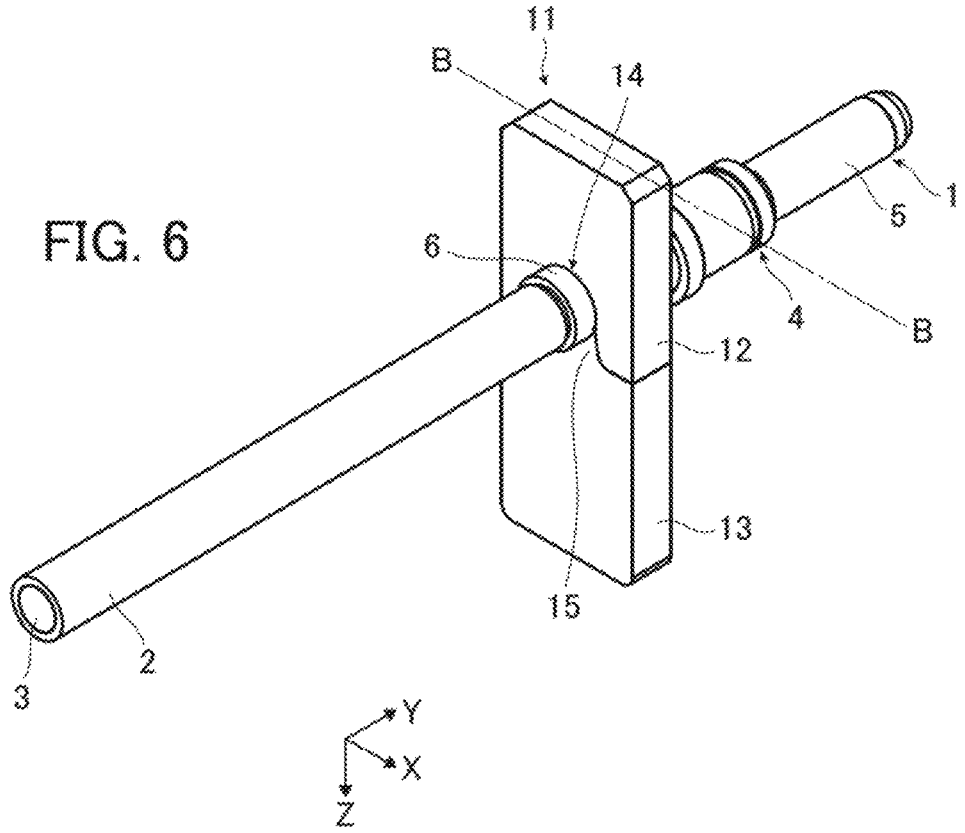
FIG. 6 is a perspective view showing the crimping die and the conductive wire with a terminal at crimping.
Figure 7:
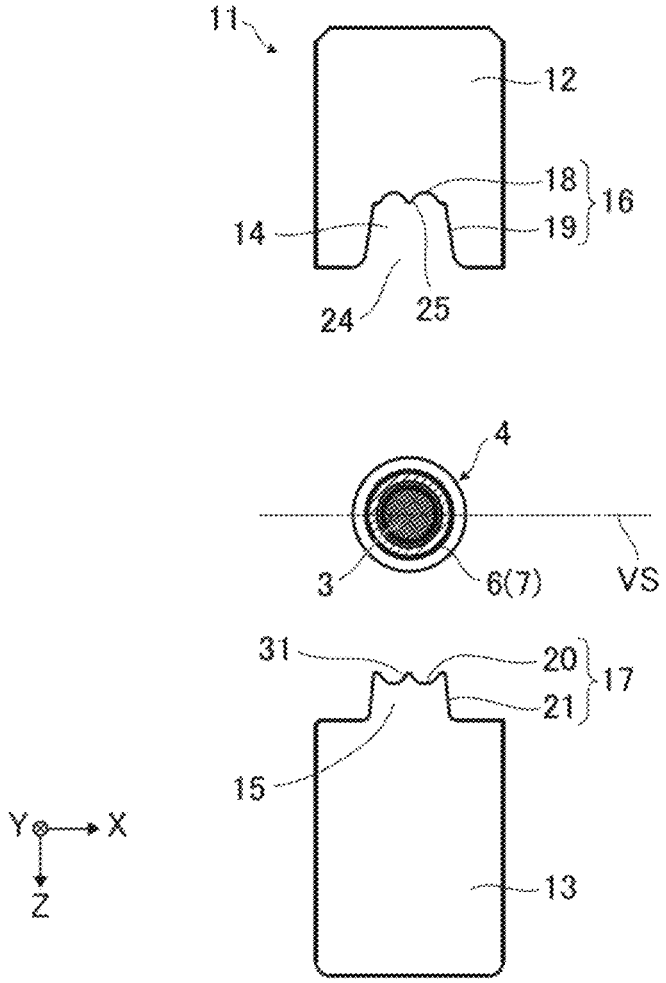
FIG. 7 is a cross-sectional view taken along line B-B in FIG. 5.
Figure 8:
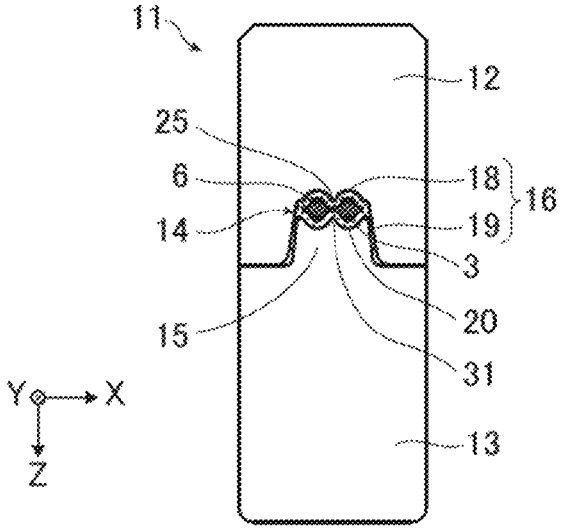
FIG. 8 is a cross-sectional view taken along line B-B in FIG. 6.
Figure 9:
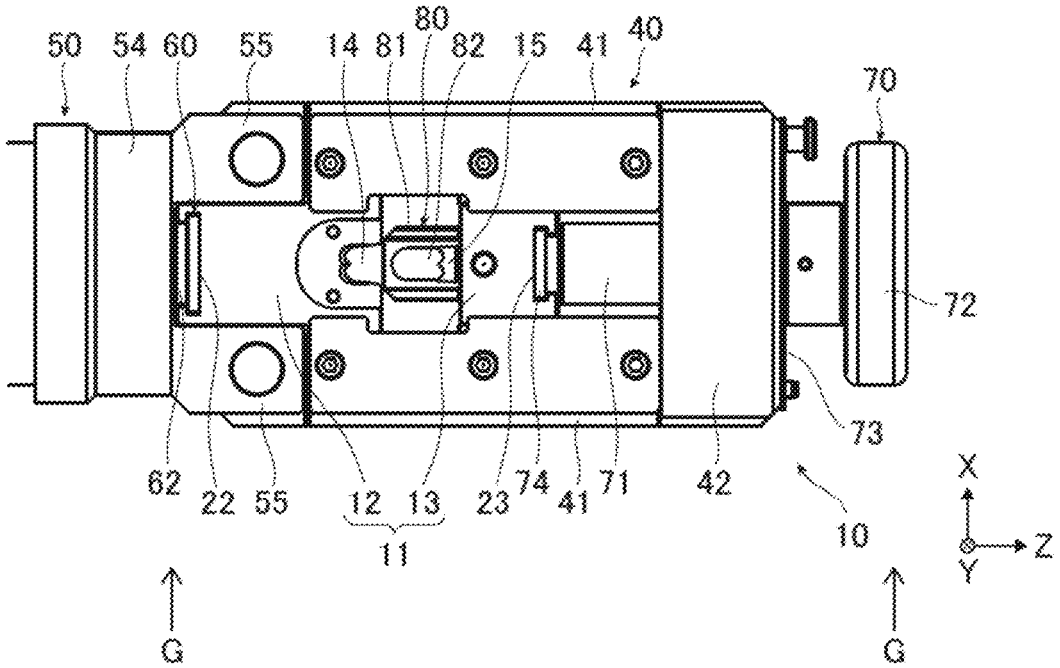
FIG. 9 is an enlarged plan view of the crimping die and a region therearound in the crimping equipment before crimping.
Figure 10:
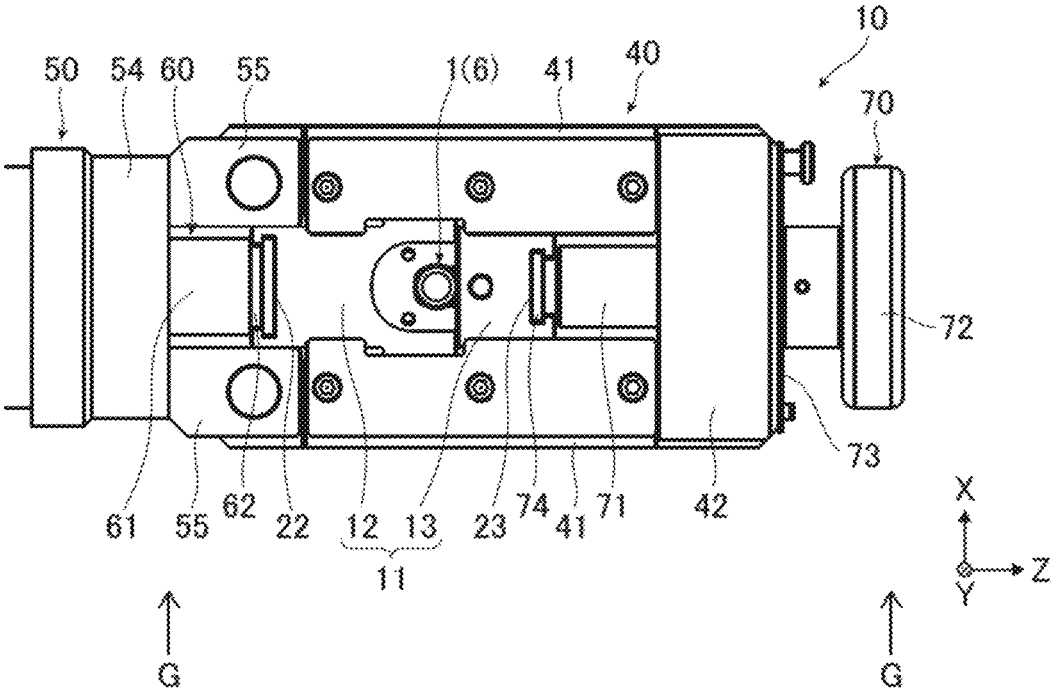
FIG. 10 is an enlarged plan view of the crimping die and the region therearound in the crimping equipment at crimping.
Figure 11:
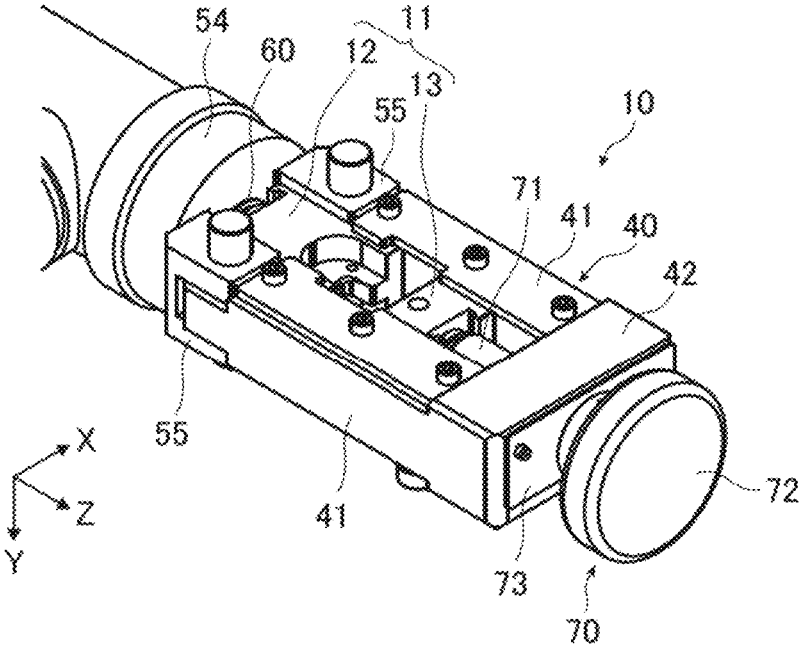
FIG. 11 is an enlarged perspective view of the crimping die and a region therearound in the crimping equipment before crimping.
Figure 12:
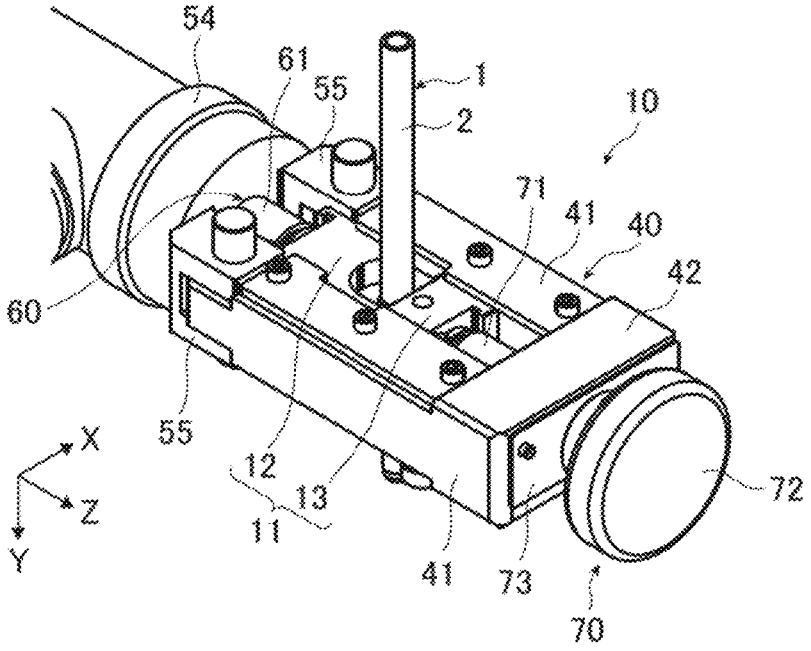
FIG. 12 is an enlarged perspective view of the crimping die and the region therearound in the crimping equipment at crimping.
Figure 13:
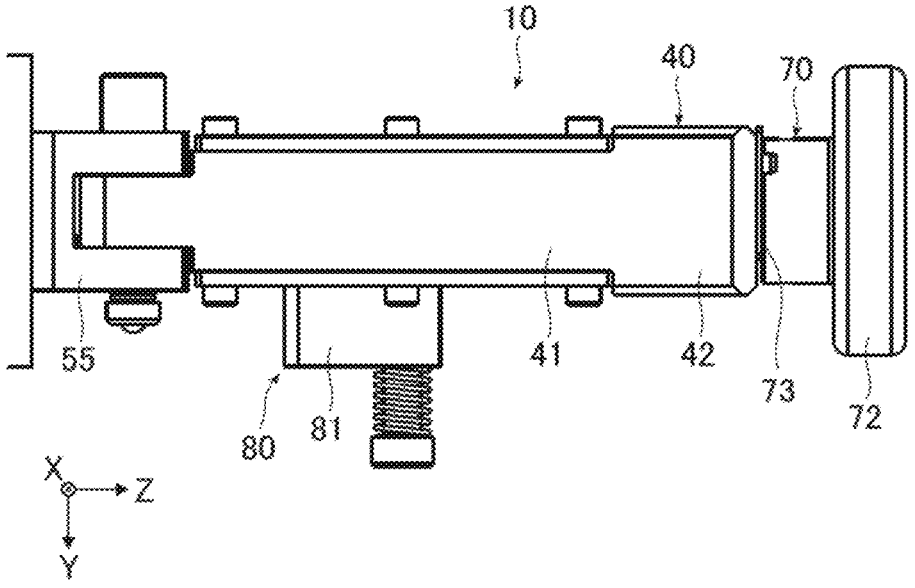
FIG. 13 is a side view of part of the crimping equipment before crimping, as viewed from the arrow direction G-G in FIG. 9.
Figure 14:
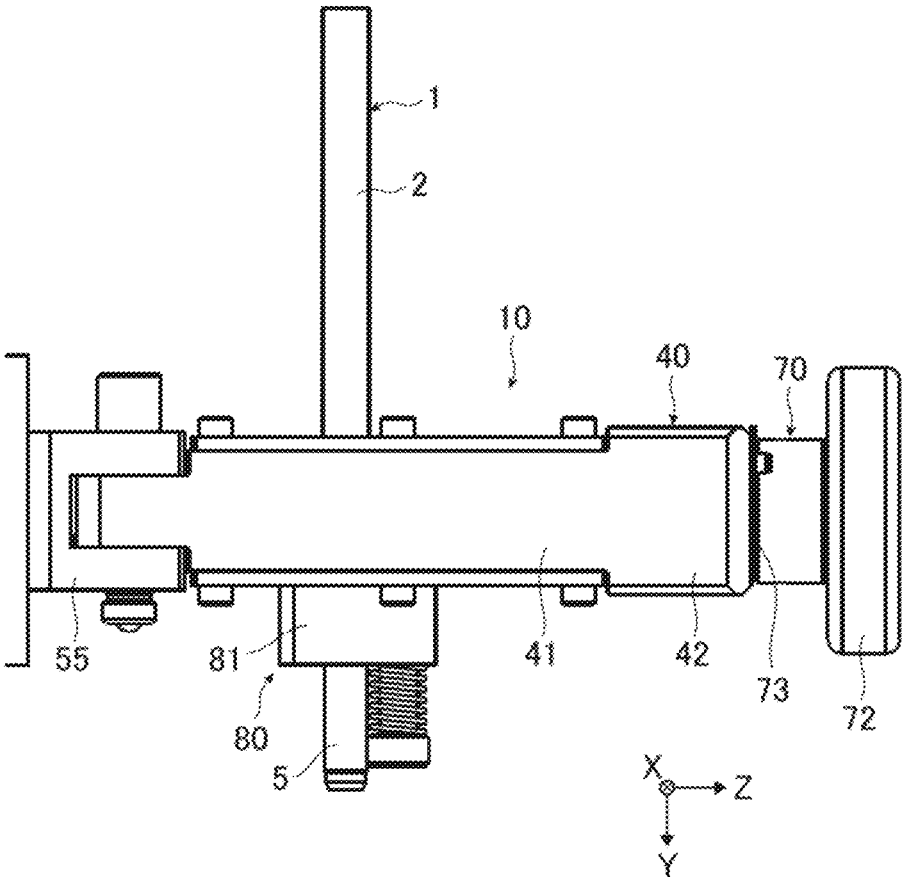
FIG. 14 is a side view of part of the crimping equipment at crimping, as viewed from the arrow direction G-G in FIG. 10.

Configurations of Crimping Equipment and Crimping Die According to Embodiment 1 of the Invention Next, the configurations of a crimping equipment (hereinafter called "crimping equipment 10") and a crimping die (hereinafter called "crimping die 11") according to Embodiment 1 of the invention are described with reference to FIGS. 4 to 14. FIG. 4 is a perspective view showing the whole of the crimping equipment 10. FIGS. 5 and 6 are perspective views showing the crimping die 11 and the terminal-attached conductive wire 1, where FIG. 5 shows the state before crimping, and FIG. 6 shows the state at crimping. FIG. 7 is a cross-sectional view taken along line B-B in FIG. 5. FIG. 8 is a cross-sectional view taken along line B-B in FIG. 6. Note that in FIGS. 7 and 8, hatching is omitted from the cross sections of a first die piece 12 and a second die piece 13 for convenience of illustration. FIGS. 9 and 10 are enlarged plan views of the crimping die 11 and a region therearound in the crimping equipment 10, where FIG. 9 shows the state before crimping, and FIG. 10 shows the state at crimping. FIGS. 11 and 12 are enlarged perspective views of the crimping die 11 and a region therearound in the crimping equipment 10, where FIG. 11 shows the state before crimping, and FIG. 12 shows the state at crimping. FIGS. 13 and 14 are side views of a part of the crimping equipment 10 as viewed from the arrow direction G-G in FIGS. 9 and 10, where FIG. 13 shows the state before crimping, and FIG. 14 shows the state at crimping.

The crimping equipment 10 has the crimping die 11 as shown in FIG. 4 and crimps the crimp portion 6 of the terminal fitting 4 onto the conductive wires 3 lying in the crimp portion 6 by means of the crimping die 11. To be more specific, as shown in FIGS. 5 to 8, the crimping die 11 is composed of the first die piece 12 (so-called crimper) and the second die piece 13 (so-called anvil). As shown in FIGS.

5 and 7, the first die piece 12 has a recess portion 14 having a somewhat large depth. The second die piece 13 has a protrusion portion 15 having a substantially rectangular shape in a plan view and protruding toward the first die piece 12. An inner wall surface 16 of the recess portion 14 corresponds in shape to an outer surface 17 of the protrusion portion 15. More specifically, as shown in FIG. 7, a bottom wall surface 18 that is the innermost part of the inner wall surface 16 of the recess portion 14 substantially coincides in shape with a top end surface 20 that is the upper end part of the outer surface 17 of the protrusion portion 15.

When the crimping equipment 10 is operated, the first die piece 12 linearly moves toward the second die piece 13 with the crimp portion 6 having the conductive wires 3 therein being placed between the recess portion 14 and the protrusion portion 15. Consequently, as shown in FIGS. 6 and 8, the protrusion portion 15 enters the recess portion 14, so that the crimp portion 6 (precisely, crimp part 7) having the conductive wires 3 therein is sandwiched between the inner wall surface 16 of the recess portion 14 and the outer surface 17 of the protrusion portion 15. This allows the bottom wall surface 18 and the top end surface 20 to together press the outer peripheral surface of the crimp part 7, and the pressing force acts to compress and deform the crimp part 7 of circular shape into a narrowed elliptical shape. Thus, the crimp portion 6 is crimped on and joined with the conductive wires 3 lying in the crimp portion 6.

The recess portion 14 and the protrusion portion 15 are described later in detail.

In the following description, the depth direction of the first die piece 12 and the second die piece 13 is defined as "Y direction," and the direction in which the first die piece 12 moves "Z direction." The X, Y and Z directions defined with respect to the crimping equipment 10 and the crimping die 11 are equivalent to the X, Y and Z directions provided for the terminal-attached conductive wire 1 shown in FIG. 1. In other words, the direction in which the conductive wires 3 inside the crimping portion 6 extend (that is, the Y direction) and the depth direction of the first die piece 12 and the second die piece 13 (that is, the Y direction) are the same as each other at crimping.

In the following description, the side on which the second die piece 13 is situated when viewed from the first die piece 12 side in the Z direction is defined as "+Z side," and the side on which the first die piece 12 is situated when viewed from the second die piece 13 side is defined as "−Z side."

Next, the whole structure of the crimping equipment 10 is described. As shown in FIGS. 4 and 9 to 12, the crimping equipment 10 has a base unit 40, a power supply unit 50, a piston unit 60, a pressure amount adjusting unit 70 and a terminal fitting setting unit 80 around the crimping die 11.

The base unit 40 is a device for supporting the crimping die 11, the power supply unit 50, the piston unit 60 and the pressure amount adjusting unit 70. As shown in FIGS. 4 and 9 to 12, the base unit 40 has a pair of elongated blocks 41 arranged in parallel and a connecting block 42 interconnecting the pair of elongated blocks 41. The pair of elongated blocks 41 are each a block body elongated in the Z direction. The connecting block 42 is joined with one ends (+Z side ends) in the longitudinal direction of the pair of elongated blocks 41 to connect the one ends to each other.

As shown in FIGS. 4 and 9, the crimping die 11 is sandwiched between the pair of elongated blocks 41 in the X direction. The power supply unit 50 and the piston unit 60 are attached to the other ends (−Z side ends) of the pair of elongated blocks 41 on the opposite side from the position of the connecting block 42 in the Z direction. The pressure amount adjusting unit 70 is assembled to the connecting block 42 on the +Z side of the connecting block 42.

The power supply unit 50 is a device for supplying power to the piston unit 60. As shown in FIG. 4, the power supply unit 50 has a power source cord 51 connected to a commercial power source (not shown) that is a source of power, a motor 52 driven by the power supplied from the commercial power source, and a gun type casing 53. Although not shown in FIG. 4 or other drawings, the casing 53 houses therein a power supply circuit connected to the power supply cord 51, a substrate used for motor control, and a transmission mechanism for transmitting the rotating force of the motor 52 to the piston unit 60.

A trigger 53B to be operated by the user is attached to the casing 53. Upon operation of the trigger 53B, the motor 52 rotates, and the piston unit 60 is powered by the resulting rotational force and thereby operates. Consequently, the first die piece 12 moves to the 4Z side toward the second die piece 13.

While the power source of this embodiment is a commercial power source, the invention is not limited thereto, and a portable battery may be used as the power source.

As shown in FIG. 4, a cover 54 is attached to the fore end (+Z side end) of a cylindrical portion 53A extending in the Z direction in the casing 53. As shown in FIGS. 4, 13 and 14, a pair of fixing blocks 55 aligned in the X direction project from the cover 54. Each fixing block 55 is of substantially C shape in a side view as shown in FIGS. 13 and 14 and is pinned on the other end (−Z side end) in the longitudinal direction of the corresponding one of the pair of elongated blocks 41 of the base unit 40 while holding the other end. Thus, the power supply unit 50 is assembled to the base unit 40.

The piston unit 60 is a device for moving the first die piece 12 to the +Z side toward the second die piece 13 by using the power supplied from the power supply unit 50. As shown in FIG. 10, the piston unit 60 has a piston 61 movable forward and backward in the Z direction. The piston 61 is assembled to the power supply unit 50 (precisely, the power transmission mechanism of the power supply unit 50). Upon operation of the trigger 53B, the power supplied from the power supply unit 50 makes the piston 61 move toward the +Z side, i.e., to a pushing position. This movement (pushing movement) allows the first die piece 12 to move to the +Z side toward the second die piece 13.

The amount of stroke of the piston 61 (i.e., the amount of movement of the first die piece 12) is uniform. Therefore, every time the piston 61 arrives at the pushing position, the first die piece 12 is always placed at the same position in the Z direction.

As shown in FIG. 4, a retracting lever 53C to be operated by the user is attached to the casing 53 of the power supply unit 50. Upon operation of the retracting lever 53C, a retracting mechanism (not shown) disposed in the casing 53 operates so that the piston 61 in the pushing position moves to the −Z side and retracts to the initial position. This movement (retracting movement) allows the first die piece 12 to move away from the second die piece 13.

As shown in FIGS. 9 and 10, a piston-side aligning adopter 62 of stepped cylindrical shape is provided at the tip (+Z side end) of the piston 61. The piston-side aligning adopter 62 is fitted in a slot hole (hereinafter called "first slot hole 22") formed at the rear end (−Z side end) of the first die piece 12, as shown in FIGS. 9 and 10. When the piston-side aligning adopter 62 is fitted into the first slot hole 22, the piston 61 and the first die piece 12 are joined to each other. Further, when the piston-side aligning adopter 62 is fitted into the first slot hole 22, the position of the central axis of the piston 61 is adjusted to coincide (is aligned) in the X direction with the middle in the lateral width direction of the first die piece 12.

The pressure amount adjusting unit 70 is a device for adjusting the amount of pressure applied to the crimp portion 6 at crimping, more specifically, the amount of deformation of the crimp portion 6 in the Z direction (that is, the thickness of the crimp part 7 after crimping). As shown in FIGS. 4 and 9 to 12, the pressure amount adjusting unit 70 has a movable rod 71 movable forward and rearward in the Z direction, a knob type handle 72 attached to the rear end (+Z side end) of the movable rod 71, and a spacer 73 for pressure amount adjustment. The movable rod 71 is inserted in an insertion hole formed in the connecting block 42 of the base unit 40. The movable rod 71 is constituted of a threaded rod whose outer peripheral surface has an external thread and engages an internal thread provided in the inner peripheral surface of the insertion hole.

The central axis of the movable rod 71 coincides with the central axis of the piston 61 in position in the X direction. As shown in FIGS. 9 and 10, a movable rod-side aligning adopter 74 of stepped cylindrical shape is provided at the tip (−Z side end) of the movable rod 71. The movable rod-side aligning adopter 74 is fitted in a slot hole (hereinafter called "second slot hole 23") formed at the rear end (+Z side end) of the second die piece 13, as shown in FIGS. 9 and 10. When the movable rod-side aligning adopter 74 is fitted into the second slot hole 23, the movable rod 71 and the second die piece 13 are joined to each other. Further, since the movable rod-side aligning adopter 74 is fitted in the second slot hole 23, the position of the central axis of the movable rod 71 coincides (is aligned) in the X direction with the middle in the lateral width direction of the second die piece 13.

When the handle 72 is operated (specifically, rotated clockwise), the movable rod 71 moves toward the −Z side and arrives at the limit position at the end. The limit position is a position where the fore end (−Z side end surface) of the handle 72 abuts on the outer surface (the surface facing the handle 72 in the Z direction) of the connecting block 42 or the spacer 73. Upon arrival of the movable rod 71 at the limit position, the second die piece 13 is set to a crimp performing position in the Z direction.

The crimp performing position of the second die piece 13 is adjustable by use of the spacer 73. Specifically, the spacer 73 made of a flat plate material with a uniform thickness is detachably attached to the outer surface (the surface facing the handle 72 in the Z direction) of the connecting block 42. The limit position of the movable rod 71 is changed by suitably replacing the spacer 73 (precisely, with another spacer 73 having a different thickness), and consequently, the crimp performing position of the second die piece 13 is adjusted in the Z direction. The change in the crimp performing position of the second die piece 13 results in the change in the amount of pressure applied to the crimp portion 6 at crimping, that is, the thickness of the crimp part 7 after crimping.

The terminal fitting setting unit 80 is a device for holding the terminal fitting 4 having the conductive wires 3 inside the crimp portion 6, at crimping, between the first die piece 12 and the second die piece 13 in the Z direction. The terminal fitting setting unit 80 has a holding block 81 shown in FIGS. 13 and 14. The holding block 81 is disposed under the crimping die 11 (on the +Y side of the crimping die 11) and, for example, fixed to the bottom surface (end surface on the +Y side) of the second die piece 13 by a screw or other means.

As shown in FIG. 9, the holding block 81 fixed to the bottom surface of the second die piece 13 somewhat protrudes beyond the fore end (−Z side end) of the second die piece 13, and a long hole 82 is formed in the protruding portion. As shown in FIG. 9, the long hole 82 is exposed between the recess portion 14 of the first die piece 12 and the protrusion portion 15 of the second die piece 13 in the Z direction before crimping (i.e., when the first die piece 12 is separated from the second die piece 13). In this state, the terminal portion 5 of the terminal fitting 4 having the conductive wires 3 inside the crimp portion 6 is inserted into the long hole 82 from the −Y side. Thus, the terminal fitting 4 is set between the first die piece 12 and the second die piece 13 in the Z direction. When the terminal fitting 4 is set between the first die piece 12 and the second die piece 13, a certain part of the outer peripheral surface of the crimp portion 6 (precisely, the crimp part 7) faces the bottom wall surface 18 of the recess portion 14 of the first die piece 12, and the opposite part thereof faces the top end surface 20 of the protrusion portion 15 of the second die piece 13.

Next, a crimping operation using the crimping die 11 is described as an example of the operation of the crimping equipment 10 having the configuration described above. For the crimping operation, the crimping die 11, the power supply unit 50, the piston unit 60 and the pressure amount adjusting unit 70 are mounted to specified locations of the base unit 40. At this time, the first die piece 12 and the second die piece 13 composing the crimping die 11 are selected depending on the size of the terminal fitting 4 (precisely, the outer diameter of the crimp portion 6) to be crimped, and the selected first and second die pieces 12 and 13 are placed between the pair of elongated blocks 41. The holding block 81 of the terminal fitting setting unit 80 is fixed to the bottom surface (end surface on the +Y side) of the second die piece 13. The spacer 73 having a thickness corresponding to a desired amount of pressure is attached to the outer surface (end surface on the +Z side) of the connecting block 42.

Subsequently, the handle 72 of the pressure amount adjusting unit 70 is operated to make the movable rod 71 move toward the −Z side up to the limit position (i.e., the position where the fore end of the handle 72 abuts on the spacer 73). Thus, the second die piece 13 is situated in the crimp performing position in the Z direction. In this stage, the recess portion 14 of the first die piece 12 and the protrusion portion 15 of the second die piece 13 are separated from each other in the Z direction, and the long hole 82 of the holding block 81 is exposed therebetween. In this state, the terminal fitting 4 having the conductive wires 3 inside the crimp portion 6 is held, and the terminal portion 5 of the terminal fitting 4 is inserted into the long hole 82, whereby the terminal fitting 4 is set in a crimp position.

After the setting of the terminal fitting 4 is completed, upon operation of the trigger 53B, the piston 61 is pushed toward the +Z side, so that the first die piece 12 is moved toward the second die piece 13. Consequently, the protrusion portion 15 of the second die piece 13 enters the recess portion 14 of the first die piece 12, the crimp portion 6 of the terminal fitting 4 is sandwiched between the bottom wall surface 18 of the recess portion 14 and the top end surface 20 of the protrusion portion 15, and the crimp portion 6 is pressed by both the bottom wall surface 18 and the top end surface 20. Thereafter, the retracting lever 53C is operated to retract the piston 61 toward the −Z side so that the first die piece 12 is separated from the second die piece 13, thereby releasing the pressure; then, the trigger 53B is again operated to move the first die piece 12 toward the second die piece 13 to again sandwich the crimp portion 6 between the bottom wall surface 18 of the recess portion 14 and the top end surface 20 of the protrusion portion 15.

As a result of repetitive pressing and releasing operation as above, the crimp portion 6 having a circular cross section (the crimp portion 6 shown in FIG. 3) is compressed and deformed to a narrowed elliptical shape in cross section, whereby the crimp portion 6 is crimped (swaged) onto the conductive wires 3 lying in the crimp portion 6. After the crimping is completed, the fitting terminal 4 whose terminal portion 5 is inserted in the long hole 82 of the holding block 81 is pulled out toward the −Y side, so that the terminal fitting 4 is removed from the crimping die 11. The crimping operation of the crimping equipment 10 finishes at this point, and the terminal-attached conductive wire 1 is completed.

Figure 15:
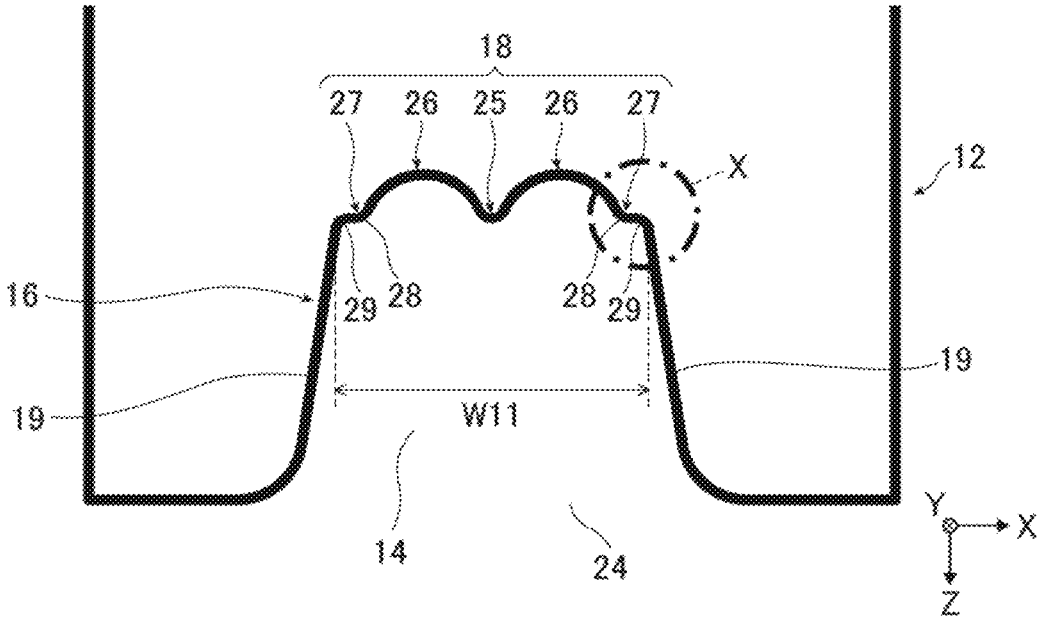
FIG. 15 is a plan view of a recess portion of a first die piece according to Embodiment 1.
Figure 16:
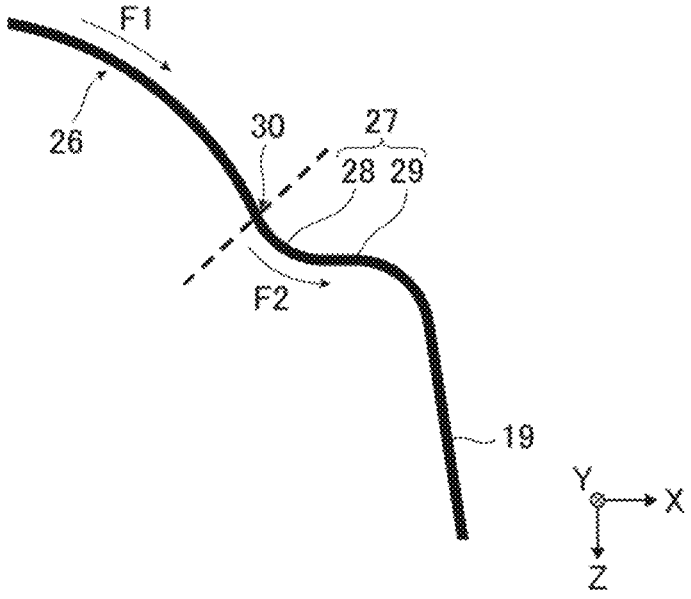
FIG. 16 is an enlarged view of a region designated by X in FIG. 15.
Figure 17:
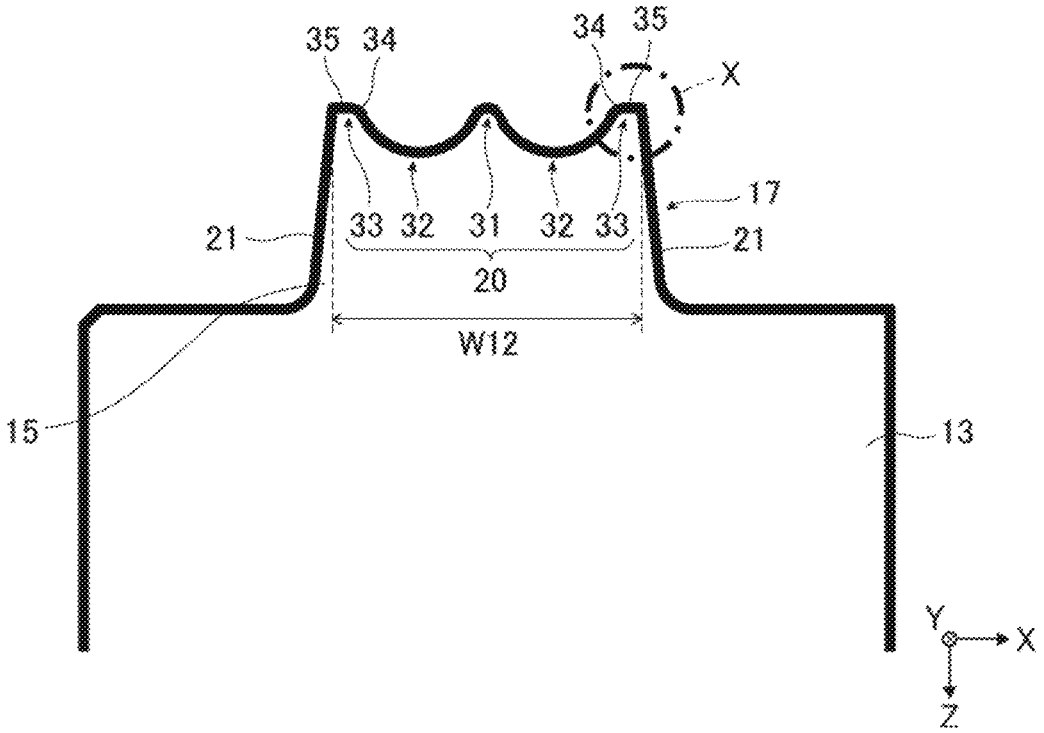
FIG. 17 is a plan view of a protrusion portion of a second die piece according to Embodiment 1.
Figure 18:
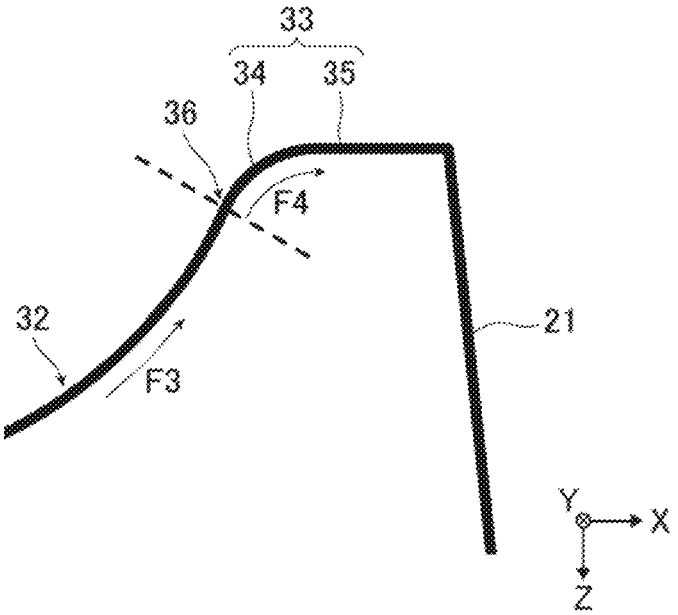
FIG. 18 is an enlarged view of a region designated by X in FIG. 17.

Next, the recess portion 14 of the first die piece 12 and the protrusion portion 15 of the second die piece 13 are further described with reference to FIGS. 15 to 18 in addition to FIGS. 5 and 6 mentioned above. FIG. 15 is a plan view of the recess portion 14. FIG. 16 is an enlarged view of a region designated by X in FIG. 15. FIG. 17 is a plan view of the protrusion portion 15. FIG. 18 is an enlarged view of a region designated by X in FIG. 17.

In this embodiment, the recess portion 14 and the protrusion portion 15 are in the positions corresponding to each other and have the shapes corresponding to each other as shown in FIGS. 5 and 6. Specifically, the middle position of the recess portion 14 in the lateral width direction (X direction) coincides with the middle position of the protrusion portion 15 in the lateral width direction (X direction). The inner wall surface 16 of the recess portion 14 and the outer surface 17 of the protrusion portion 15 have similar shapes that are not exact but approximate inversions of each other in the Z direction.

The shape of the inner wall surface 16 of the recess portion 14 and that of the outer surface 17 of the protrusion portion 15 are described in detail below. In the following, described are the shapes thereof when the recess portion 14 and the protrusion portion 15 are viewed in the Y direction (more precisely, from the −Y side), i.e., in a plan view, unless otherwise noted. For convenience of description, the +X side with respect to the reference position (for instance, the position where a certain portion is formed) is also called "right side," and the −X side with respect thereto is also called "left side."

(Inner Wall Surface of Recess Portion)

First, the shape of the inner wall surface 16 of the recess portion 14 is described. As shown in FIG. 15, the inner wall surface 16 of the recess portion 14 has the bottom wall surface 18 and a pair of recess-side lateral end surfaces 19 situated on the opposite sides (+X side and −X side) of the bottom wall surface 18. As shown in FIG. 15, the pair of recess-side lateral end surfaces 19 of the inner wall surface 16 are each inclined such that the distance between the recess-side lateral end surfaces 19 increases as advancing toward an opening 24 of the recess portion 14. That is, the recess portion 14 of this embodiment is a tapered recess portion that decreases in width as advancing toward the innermost side (−Z side).

The lateral width (W11 in FIG. 15) of the bottom wall surface 18 is smaller than the outer diameter (W10 in FIG. 3) of the crimp portion 6. Note that the outer diameter W10 of the crimp portion 6 is the outer diameter of the crimp portion 6, more precisely, the outer diameter of the crimp part 7 before crimping (i.e., before compression and deformation). The lateral width W11 of the bottom wall surface 18 is the distance between the right end (end on the +X side) and the left end (end on the −X side) of the bottom wall surface 18, and more specifically, the distance between the right end of a recess-side connecting portion 29 of a recess-side curvature changing portion 27 on the right side and the left end of a recess-side connecting portion 29 of a recess-side curvature changing portion 27 on the left side, of a right and left pair of recess-side curvature changing portions 27 to be described later.

In this embodiment, there is the position where, when the crimp portion 6 before crimping enters the recess portion 14, the outer peripheral surface of the crimp portion 6 contacts both the pair of recess-side lateral end surfaces 19, and the lateral width of the recess portion 14 on the deeper side (−Z side) than that position is smaller than the outer diameter W10 of the crimp portion 6.

Describing the shape of the bottom wall surface 18, as shown in FIG. 15, the bottom wall surface 18 has a symmetric (laterally symmetric) shape with respect to the middle position of the bottom wall surface 18 in the lateral width direction (X direction) of the recess portion 14. More specifically, one recess-side projection portion 25 is provided in a middle portion of the bottom wall surface 18 in the X direction. A right and left pair of recess-side concave portions 26 are provided on the opposite sides of the recess-side projection portion 25 and adjoin the portion 25. The right and left pair of recess-side curvature changing portions 27 are provided at the opposite ends of the bottom wall surface 18 in the X direction.

The recess-side projection portion 25 projects on the +Z side toward the opening 24 of the recess portion 14. The recess-side projection portion 25 is to abut on the outer peripheral surface of the crimp portion 6 and squashes a part of the outer peripheral surface (precisely, a part facing the recess-side projection portion 25) toward the +Z side at crimping, thereby forming a narrowed shape at the part. In this embodiment, the recess-side projection portion 25 is curved in a mountain-like shape with a rounded top as shown in FIG. 15; however, the invention is not limited thereto, and the top of the recess-side projection portion 25 may be a flat surface parallel to an XY plane or a bending surface bent at an obtuse or acute angle.

As is clear from FIG. 5, the recess-side projection portion 25 extends along the depth direction (Y direction) of the first die piece 12. That is, in this embodiment, the recess-side projection portion 25 is to abut on the outer peripheral surface of the crimp portion 6 throughout the range that the recess-side projection portion 25 extends in the Y direction, at crimping.

The right and left pair of recess-side concave portions 26 separately adjoin the recess-side projection portion 25 and are each curved in a concave shape to form an arc. The radius of curvature of each recess-side concave portion 26 is substantially uniform over the entire recess-side concave portion 26 in the X direction. Each recess-side concave portion 26 extends along the depth direction (Y direction) of the first die piece 12, as with the recess-side projection portion 25.

As shown in FIG. 15, the right and left pair of recess-side curvature changing portions 27 are each situated between the corresponding recess-side concave portion 26 and the corresponding recess-side lateral end surface 19 in the X direction to adjoin both the portion 26 and the surface 19. Each recess-side curvature changing portion 27 extends along the depth direction (Y direction) of the first die piece 12, as with the recess-side projection portion 25. Further, in this embodiment, the sign of curvature of the bottom wall surface 18 changes at a boundary portion in the recess-side curvature changing portion 27 with respect to the adjacent recess-side concave portion 26.

With the bottom wall surface 18 in a plan view (i.e., viewed in the Y direction) being considered as a curve, the curvature of the bottom wall surface 18 herein refers to the curvature (degree of curving) in each portion of the curve. With the bottom wall surface 18 being considered as a curve, the sign of curvature of the bottom wall surface 18 is determined by the curving direction of an arc forming each portion of the curve. In this description, when advancing along the arc toward the +X side, the sign when the arc curves clockwise is defined as "+ (plus)," and the sign when the arc curves counterclockwise "– (minus)."

The recess-side curvature changing portion 27 is described in detail. As shown in FIG. 16, the recess-side curvature changing portion 27 is curved in a substantially S shape and has a recess-side curve portion 28 and the recess-side connecting portion 29. The recess-side curve portion 28 is curved to have a convex shape in a position adjacent to the recess-side concave portion 26 in the X direction.

The recess-side connecting portion 29 interconnects the recess-side curve portion 28 and the recess-side lateral end surface 19 in the X direction. Of the recess-side connecting portion 29, an end portion closer to the recess-side lateral end surface 19 in the X direction is curved in a concave shape.

As shown in FIG. 16, in each of the right and left pair of recess-side curvature changing portions 27, the sign of curvature of the bottom wall surface 18 changes at the end position of the recess-side curve portion 28 on the side adjacent to the recess-side concave portion 26 (the position indicated by dashed line in FIG. 16, which is hereinafter called "recess-side changing position 30"). In the configuration shown in FIG. 16, the sign F1 of curvature is plus (+) in the recess-side concave portion 26 on the left side of the recess-side changing position 30 (the side closer to the middle of the bottom wall surface 18), while the sign F2 of curvature is minus (–) in the recess-side curve portion 28 on the right side of the recess-side changing position 30 (the side farther away from the middle of the bottom wall surface 18).

In this embodiment, when the bottom wall surface 18 is seen in a plan view and considered as a curve, the recess-side changing position 30 corresponds to an inflection point of the curve, and the curvature at the recess-side changing position 30 is zero.

Further referring to the recess-side curvature changing portion 27, in this embodiment, the top of the recess-side curve portion 28 of the recess-side curvature changing portion 27 coincides with the top of the recess-side projection portion 25 in position in the 2 direction, as shown in FIG. 15. In other words, in this embodiment, the top of the recess-side projection portion 25 coincides with the top of the recess-side curve portion 28 in position in the direction in which the portion 25 projects (Z direction).

(Outer Surface of Protrusion Portion)

Next, the shape of the outer surface 17 of the protrusion portion 15 is described. As shown in FIG. 17, the outer surface 17 of the protrusion portion 15 has the top end surface 20 and a pair of protrusion-side lateral end surfaces 21 situated on the opposite sides (+X side and –X side) of the top end surface 20. The pair of protrusion-side lateral end surfaces 21 of the outer surface 17 are each inclined such that the distance between the protrusion-side lateral end surfaces 21 decreases as advancing toward the top of the protrusion portion 15. That is, the protrusion portion 15 of this embodiment is a tapered protrusion portion that decreases in width as advancing toward the top (–Z side).

The lateral width (W12 in FIG. 17) of the top end surface 20 is smaller than the outer diameter W10 of the crimp portion 6. As described above, the outer diameter W10 of the crimp portion 6 is the outer diameter of the crimp portion 6 (more precisely, the crimp part 7) before crimping. The lateral width W12 of the top end surface 20 is the distance between the right end (end on the +X side) and the left end (end on the –X side) of the top end surface 20, and more specifically, the distance between the right end of a protrusion-side connecting portion 35 of a protrusion-side curvature changing portion 33 on the right side and the left end of a protrusion-side connecting portion 35 of a protrusion-side curvature changing portion 33 on the left side, of a right and left pair of protrusion-side curvature changing portions 33 to be described later.

Describing the shape of the top end surface 20, as shown in FIG. 17, the top end surface 20 has a symmetric (laterally symmetric) shape with respect to the middle position of the top end surface 20 in the lateral width direction (X direction) of the protrusion portion 15. More specifically, one protrusion-side projection portion 31 is provided in a middle portion of the top end surface 20 in the X direction. A right and left pair of protrusion-side concave portions 32 are provided on the opposite sides of the protrusion-side projection portion 31 and adjoin the portion 31. The right and left pair of protrusion-side curvature changing portions 33 are provided at the opposite ends of the top end surface 20 in the X direction.

The protrusion-side projection portion 31 projects in the same direction as the direction in which the protrusion portion 15 projects (i.e., on the –Z side). The protrusion-side projection portion 31 is to abut on the outer peripheral surface of the crimp portion 6 and squashes a certain part of the outer peripheral surface (precisely, a part facing the protrusion-side projection portion 31) toward the –Z side at crimping, thereby forming a narrowed shape at the part. In this embodiment, the protrusion-side projection portion 31 is curved in a mountain-like shape with a rounded top as shown in FIG. 17; however, the invention is not limited thereto, and the top of the protrusion-side projection portion 31 may be a flat surface parallel to an XY plane or a bending surface bent at an obtuse or acute angle. In this embodiment, the amount of projection of the protrusion-side projection portion 31 (the amount of projection in the Z direction) is the same as that of the recess-side projection portion 25 but may be different therefrom.

As shown in FIG. 5, the protrusion-side projection portion 31 extends along the depth direction (Y direction) of the second die piece 13. That is, in this embodiment, the protrusion-side projection portion 31 is to abut on the outer peripheral surface of the crimp portion 6 throughout the range that the protrusion-side projection portion 31 extends in the Y direction, at crimping.

The right and left pair of protrusion-side concave portions 32 separately adjoin the protrusion-side projection portion 31 and are each curved in a concave shape to form an arc. The radius of curvature of each protrusion-side concave portion 32 is substantially uniform over the entire protrusion-side concave portion 32 in the X direction. Each protrusion-side concave portion 32 extends along the depth direction (Y direction) of the second die piece 13, as with the protrusion-side projection portion 31.

As shown in FIG. 17, the right and left pair of protrusion-side curvature changing portions 33 are each situated between the corresponding protrusion-side concave portion 32 and the corresponding protrusion-side lateral end surface 21 in the X direction and adjoin both the portion 32 and the surface 21. Each protrusion-side curvature changing portion 33 extends along the depth direction (Y direction) of the second die piece 13, as with the protrusion-side projection portion 31. Further, in this embodiment, the sign of curvature of the top end surface 20 changes at a boundary portion in the protrusion-side curvature changing portion 33 with respect to the adjacent protrusion-side concave portion 32.

With the top end surface 20 in a plan view (i.e., viewed in the Y direction) being considered as a curve, the curvature of the top end surface 20 herein refers to the curvature in each portion of the curve. Since the sign of curvature of the top end surface 20 can be determined in the same manner as for the sign of curvature of the bottom wall surface 18 described above, the description therefore is omitted.

The protrusion-side curvature changing portion 33 is described in detail. As shown in FIG. 18, the protrusion-side curvature changing portion 33 is curved in a substantially V shape and has a protrusion-side curve portion 34 and the protrusion-side connecting portion 35. The protrusion-side curve portion 34 is curved to have a convex shape in a position adjacent to the protrusion-side concave portion 32 in the X direction.

The protrusion-side connecting portion 35 interconnects the protrusion-side curve portion 34 and the protrusion-side lateral end surface 21 in the x direction and is a flat surface parallel to an XY plane or slightly inclined to an XY plane.

As shown in FIG. 18, in each of the right and left pair of protrusion-side curvature changing portions 33, the sign of curvature of the top end surface 20 changes at the end position of the protrusion-side curve portion 34 on the side adjacent to the protrusion-side concave portion 32 (the position indicated by dashed line in FIG. 18, which is hereinafter called "protrusion-side changing position 36"). In the configuration shown in FIG. 18, the sign F3 of curvature is minus (−) in the protrusion-side concave portion 32 on the left side of the protrusion-side changing position 36 (the side closer to the middle of the top end surface 20), while the sign F4 of curvature is plus (+) in the protrusion-side curve portion 34 on the right side of the protrusion-side changing position 36 (the side farther away from the middle of the top end surface 20).

In this embodiment, when the top end surface 20 is seen in a plan view and considered as a curve, the recess-side changing position 30 corresponds to an inflection point of the curve, and the curvature at the recess-side changing position 30 is zero.

Further referring to the protrusion-side curvature changing portion 33, in this embodiment, the top of the protrusion-side curve portion 34 of the protrusion-side curvature changing portion 33 coincides with the top of the protrusion-side projection portion 31 in position in the Z direction, as shown in FIG. 17. In other words, in this embodiment, the top of the protrusion-side projection portion 31 coincides with the top of the protrusion-side curve portion 34 in position in the direction in which the portion 31 projects (Z direction).

Furthermore, in this embodiment, in the state where the bottom wall surface 18 of the recess portion 14 and the top end surface 20 of the protrusion portion 15 face each other (e.g., the state shown in FIG. 9), the recess-side projection portion 25, the right and left pair of recess-side concave portions 26 and the right and left pair of recess-side curve portions 28 of the bottom wall surface 18 have the mirror image relationship with the protrusion-side projection portion 31, the right and left pair of protrusion-side concave portions 32 and the right and left pair of protrusion-side curve portions 34. The mirror image relationship herein refers to a symmetric relationship with respect to an imaginary XY plane (imaginary plane VS in FIG. 7) situated in the middle position in the Z direction between the bottom wall surface 18 and the top end surface 20, precisely, between the top of the recess-side projection portion 25 and the top of the protrusion-side projection portion 31.

In the foregoing, the description has been made on the shape of the bottom wall surface 18 of the recess portion 14 of the first die piece 12 and the shape of the top end surface 20 of the protrusion portion 15 of the second die piece 13 as characteristics of the crimping equipment 10 and the crimping die 11 according to this embodiment. Owing to those characteristics, the crimping equipment 10 and the crimping die 11 according to this embodiment can suitably compress and deform the crimp portion 6 of the terminal fitting 4 into a narrowed elliptical shape, thus the crimp portion 6 can be crimped well onto the conductive wires 3 lying in the crimp portion 6.

Figure 32:
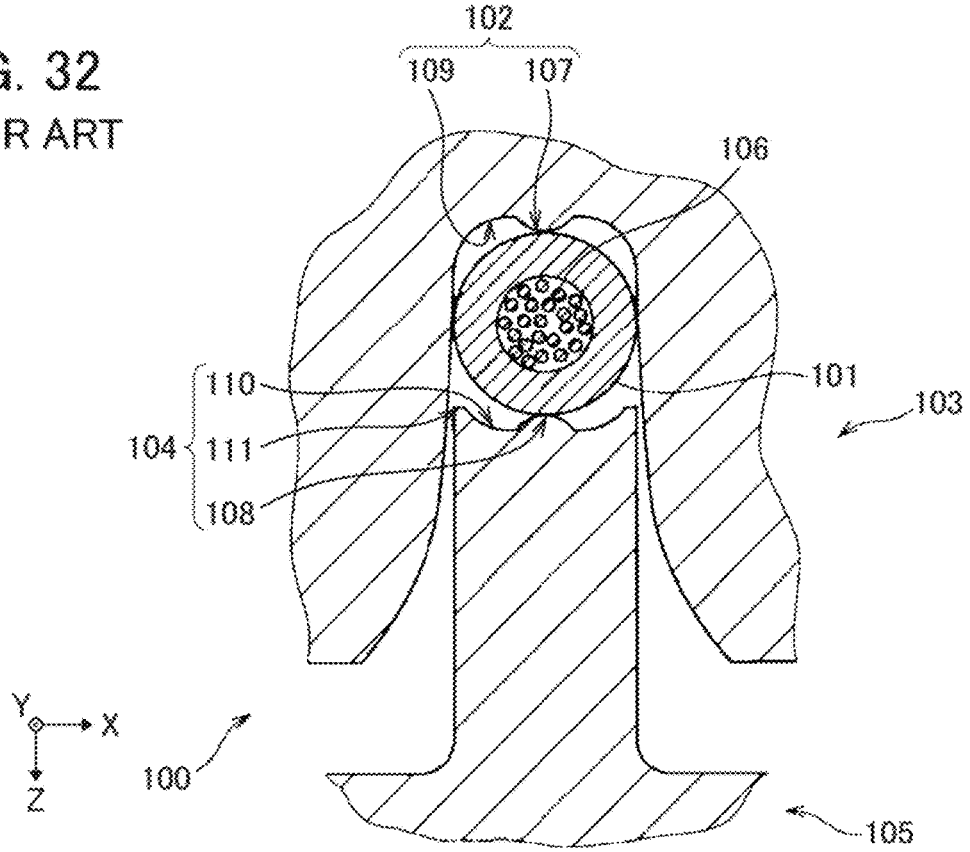
FIG. 32 PRIOR ART
FIG. 32 is a cross-sectional view of a conventional crimping die immediately before crimping.
Figure 33:
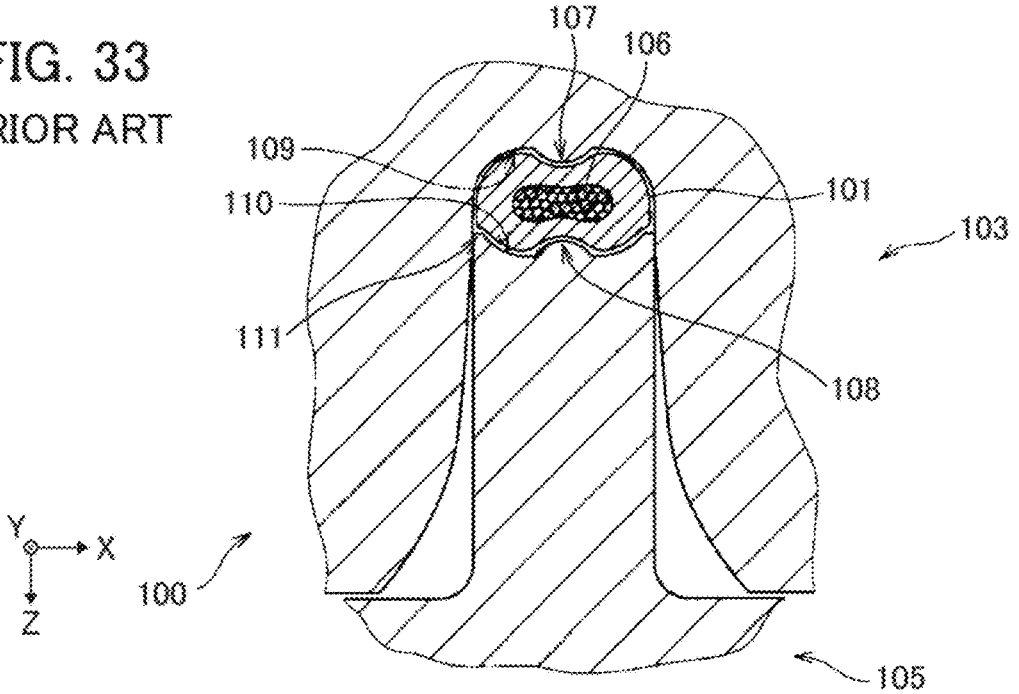
FIG. 33 PRIOR ART
FIG. 33 is a cross-sectional view of the conventional crimping die immediately after completion of the crimping.

Specifically, as described in "BACKGROUND OF THE INVENTION" above, in the crimping die (i.e., the conventional die 100) illustrated in JP 5686064 B, the bottom portion of the recess surface 102 and the top end portion of the protrusion surface 104 are different in shape from each other as shown in FIGS. 32 and 33. Therefore, the crimp portion 101 after crimping should have a distorted shape in cross section in the Z direction. More specifically, the bottom portion of the recess surface 102 in the conventional die 100 has the curved surfaces 109 that are curved in a concave shape separately from the lateral sides of the first projection portion 107 and continuously extend up to the lateral end portions of the recess surface 102. The expression "the curved surfaces 109 . . . continuously extend" herein means that the sign of curvature of the curved surfaces 109 does not change in any position.

On the other hand, while the top end portion of the protrusion surface 104 in the conventional die 100 has the curved surfaces 110 curved in a concave shape that extend separately from the lateral sides of the second projection portion 108 toward the lateral ends of the top end portion of the protrusion surface 104, the top end portion of the protrusion surface 104 is bent at intermediate positions and forms the flat surfaces 111 extending from the bending portions to the lateral ends of the top end portion of the protrusion surface 104.

As described above, in the conventional die 100, the bottom portion of the recess surface 102 and the top end portion of the protrusion surface 104 are different in shape from each other. Accordingly, crimping using the conventional die 100 makes the crimp portion 101 unsuitably deformed in the longitudinal direction as shown in FIG. 33. More specifically, the crimp portion 101 is compressed and deformed through crimping such that on the side facing the protrusion surface 104, the thickness of the portion 101 becomes uniform because of the above-described shape of the protrusion surface 104. On the other hand, on the opposite side of the crimp portion 101 that faces the recess surface 102, the crimp portion 101 is compressed and deformed such that a material part of the crimp portion 101 is forced out from the point pressed with the first projection portion 107 toward the lateral sides (in the X direction) along the above-described curved surfaces 109. Consequently, the crimp portion 101 is unsuitably deformed in the Z direction, and in particular, the portion pressed with the first projection portion 107 is decreased in thickness, so that cracks or fractures may be easily generated there.

In contrast, in this embodiment, the recess-side curvature changing portion 27 is provided at each end of the bottom wall surface 18 of the recess portion 14, and the sign of curvature changes at the boundary portion between the recess-side curvature changing portion 27 and the recess-side concave portion 26. In other words, the curving direction of the bottom wall surface 18 of the recess portion 14 is switched at the boundary portion between the recess-side curvature changing portion 27 and the recess-side concave portion 26. Similarly, the protrusion-side curvature changing portion 33 is provided at each end of the top end surface 20 of the protrusion portion 15, and the sign of curvature changes at the boundary portion between the protrusion-side curvature changing portion 33 and the protrusion-side concave portion 32. In other words, the curving direction of the top end surface 20 of the protrusion portion 15 is switched at the boundary portion between the protrusion-side curvature changing portion 33 and the protrusion-side concave portion 32.

Owing to the foregoing configuration, in this embodiment, the recess-side curvature changing portions 27 can prevent a material part of the crimp portion 6 from being forced out from the point pressed with the recess-side projection portion 25 toward the lateral sides (in the X direction) along the recess-side concave portions 26 at crimping. Similarly, it is possible to prevent a material part of the crimp portion 6 from being forced out from the point pressed with the protrusion-side projection portion 31 toward the lateral sides (in the X direction) along the protrusion-side concave portions 32. Thus, unsuitable deformation of the crimp portion 6 can be suppressed. In addition, this configuration makes it possible to prevent the crimp portion 6 from being locally decreased in thickness at the portion pressed with the recess-side projection portion 25 and the protrusion-side projection portion 31, thus suppressing the generation of cracks or fractures at the pressed portion.

In this embodiment, the recess portion 14 is a tapered recess portion that decreases in width as advancing toward the innermost side (−Z side), and the lateral width of the bottom wall surface 18 of the recess portion 14 is smaller than the outer diameter of the crimp portion 6. Further, in this embodiment, the protrusion portion 15 is a tapered protrusion portion that decreases in width as advancing toward the top (−Z side), and the lateral width of the top end surface 20 of the protrusion portion 15 is smaller than the outer diameter of the crimp portion 6. This configuration makes it possible to more properly compress and deform the crimp portion 6 at crimping.

To be more specific, if the lateral width of the bottom wall surface 18 of the recess portion 14 and that of the top end surface 20 of the protrusion portion 15 each coincide with the outer diameter of the crimp portion 6, when the crimp portion 6 is tried to be sufficiently crimped on the conductive wires 3 lying in the crimp portion 6, the crimp portion 6 needs to be greatly compressed and deformed in the longitudinal direction (Z direction). In this case, the ratio of the lateral length to the longitudinal length of the crimp portion 6 (the ratio of the X directional length of the crimp portion 6 to the Z directional length thereof) after crimping is to be remarkably large, and a large difference arises in thickness between a compressed and deformed portion and an undeformed portion. Accordingly, fractures and the like are easily generated at the compressed and deformed portion having a smaller thickness.

In contrast, in this embodiment, the lateral width of the bottom wall surface 18 of the recess portion 14 and that of the top end surface 20 of the protrusion portion 15 are each smaller than the outer diameter of the crimp portion 6, and this configuration can further reduce the amount of deformation of the crimp portion 6 in the longitudinal direction with respect to the amount of deformation thereof in the lateral direction in the process for crimping the crimp portion 6 onto the conductive wires 3 lying in the crimp portion 6. Consequently, in this embodiment, the ratio of the lateral length to the longitudinal length of the crimp portion 6 after crimping can be made smaller, and this leads to a smaller difference in thickness between a compressed and deformed portion and an undeformed portion, thus suppressing the generation of fractures and the like at the compressed and deformed portion.

Figure 19:
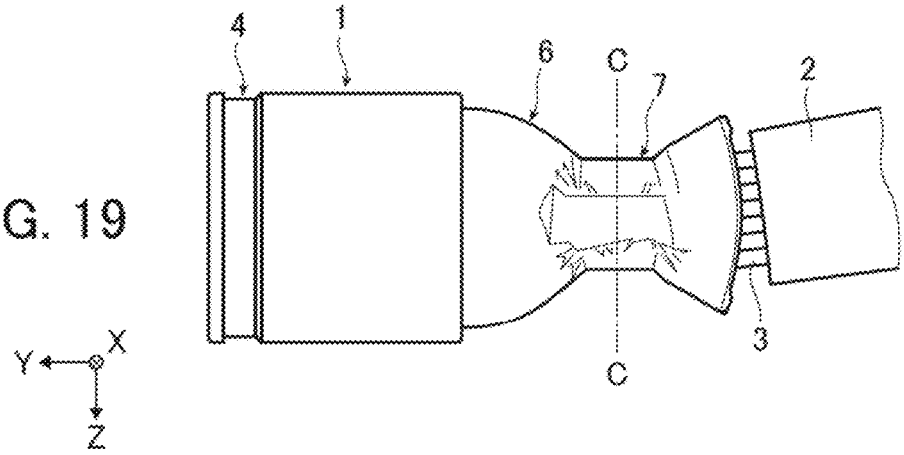
FIG. 19 is a view of a crimp portion after crimping, as viewed from a lateral side.
Figure 20:
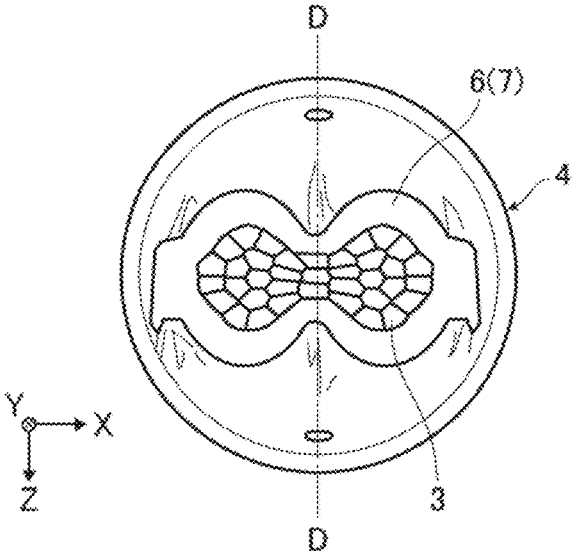
FIG. 20 is a cross-sectional view taken along line C-C in FIG. 19.
Figure 21:
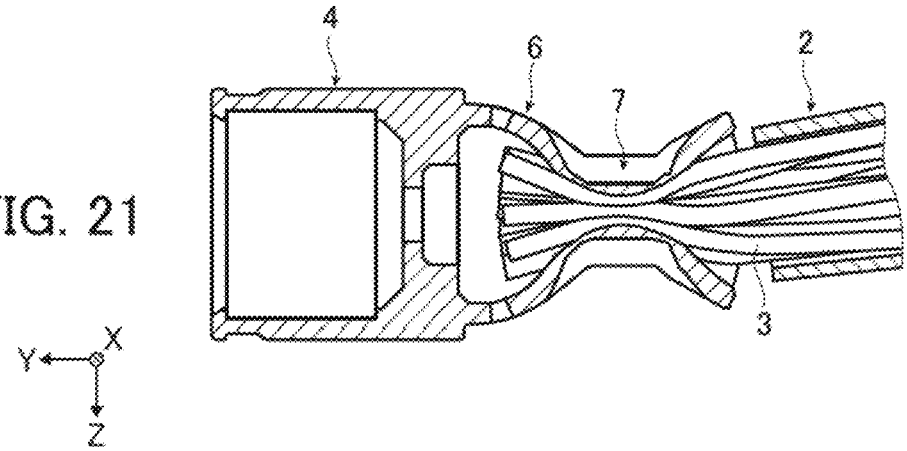
FIG. 21 is a cross-sectional view of the crimp portion shown in FIG. 19 and a region therearound taken along line D-D in FIG. 20.
Figure 22:
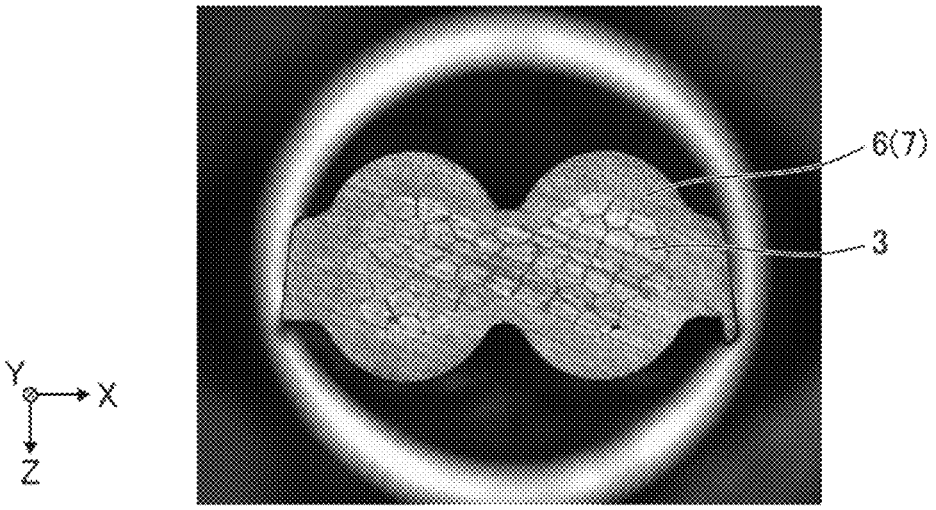
FIG. 22 is an image showing the crimp portion and conductive wires lying in the crimp portion after crimping.

Meanwhile, when attention is paid to the crimp portion 6 crimped on the conductive wires 3 by means of the crimping die 11 according to this embodiment, as shown in FIGS. 19 to 22, it can be understood that the crimp portion 6 (precisely, the crimp part 7) is properly compressed and deformed into a narrowed elliptical shape and takes on a substantially symmetric shape in the lateral direction (Z direction). Of the conductive wires 3 lying in the crimp portion 6, some conductive wires 3 situated in the narrowed portion (i.e., the portion sandwiched between the recess-side projection portion 25 and the protrusion-side projection portion 31 at crimping) are squashed to such an extent that those conductive wires 3 are properly joined with the crimp portion 6 as shown in FIGS. 20 to 22.

FIG. 19 is a view of the crimp portion 6 after crimping, as viewed from a lateral side. FIG. 20 is a cross-sectional view taken along line C-C in FIG. 19. FIG. 21 is a cross-sectional view of the crimp portion 6 and a region therearound shown in FIG. 19 taken along line D-D in FIG. 20. FIG. 22 is an image of the crimp portion 6 and the conductive wires 3 lying in the crimp portion 6 after crimping.

While, in this embodiment, the bottom wall surface 18 of the recess portion 14 has a symmetric (laterally symmetric) shape with respect to the middle of the bottom wall surface 18 in the X direction, the invention is not limited thereto, and the left half and the right half of the bottom wall surface 18 may have somewhat different shapes. Similarly, while, in this embodiment, the top end surface 20 of the protrusion portion 15 has a symmetric (laterally symmetric) shape with respect to the middle of the top end surface 20 in the X direction, the invention is not limited thereto, and the left half and the right half of the top end surface 20 may have somewhat different shapes. However, in terms of the quality of the terminal-attached conductive wire 1, it is favorable that the bottom wall surface 18 and the top end surface 20 each have a laterally symmetric shape for achieving a good appearance of the crimp portion 6 after crimping.

In this embodiment, in the state where the bottom wall surface 18 of the recess portion 14 and the top end surface 20 of the protrusion portion 15 face each other, the recess-side projection portion 25, the recess-side concave portions 26 and the recess-side curve portions 28 have the mirror image relationship with the protrusion-side projection portion 31, the protrusion-side concave portions 32 and the protrusion-side curve portions 34. However, the invention is not limited thereto, and the recess-side projection portion 25 may be somewhat different from the protrusion-side projection portion 31, the recess-side concave portions 26 may be somewhat different from the protrusion-side concave portions 32, and the recess-side curve portions 28 may be somewhat different from the protrusion-side curve portions 34. However, when the recess-side projection portion 25, the recess-side concave portions 26 and the recess-side curve portions 28 have the mirror image relationship with the protrusion-side projection portion 31, the protrusion-side concave portions 32 and the protrusion-side curve portions 34, it is possible to compress and deform the crimp portion 6 into a symmetric shape in the longitudinal direction, thus achieving a further excellent crimp connection. From this viewpoint, this embodiment is more favorable.

Configuration of Crimping Die According to Embodiment 2

In Embodiment 1, the sign of curvature of the top end surface 20 changes at the boundary portion in the protrusion-side curvature changing portion 33 with respect to the protrusion-side concave portion 32. Further, in Embodiment 1, the boundary portion where the sign of curvature of the top end surface 20 changes is the end position of the protrusion-side curve portion 34 on the side adjacent to the protrusion-side concave portion 32 (that is, the protrusion-side changing position 36). When the top end surface 20 is seen in a plan view and considered as a curve, the protrusion-side changing position 36 corresponds to an inflection point of the curve.

Figure 23:
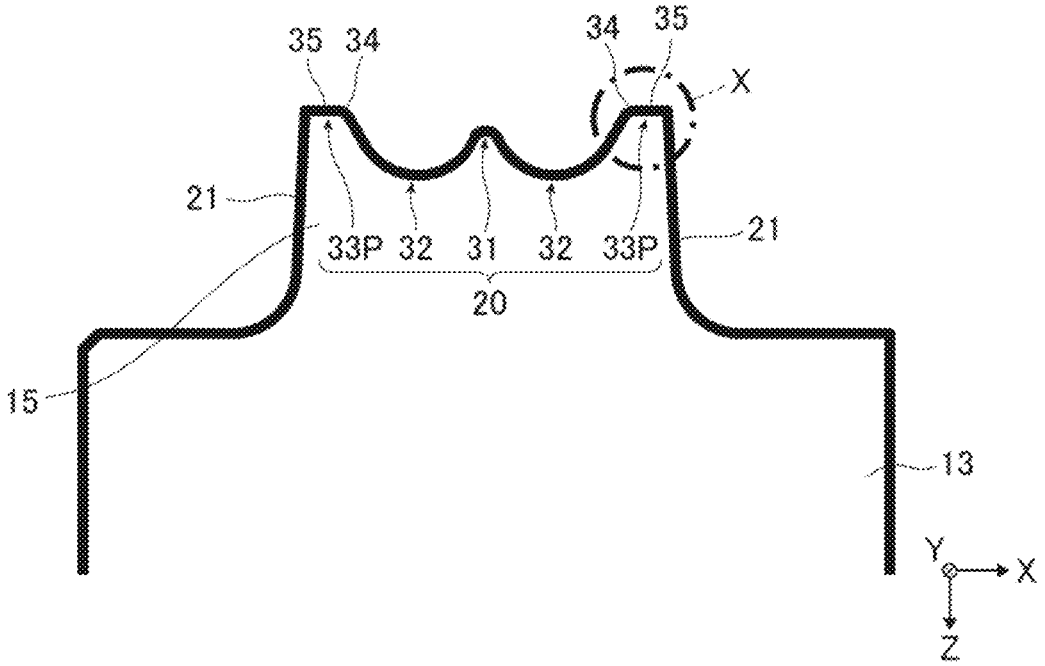
FIG. 23 is a plan view of a protrusion portion of a second die piece according to Embodiment 2.
Figure 24:
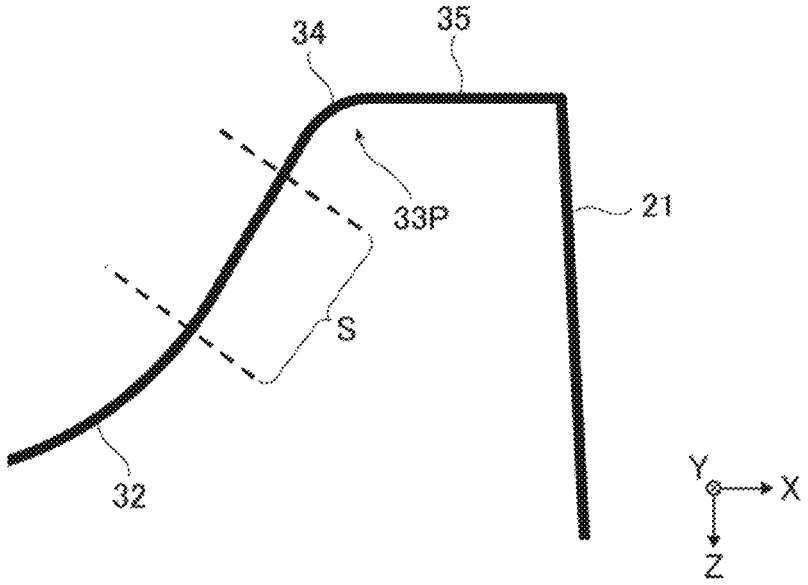
FIG. 24 is an enlarged view of a region designated by X in FIG. 23.

In regard to the above configuration, another embodiment (hereinafter called "Embodiment 2") different from Embodiment 1 is also possible. A configuration according to Embodiment 2 is described with reference to FIGS. 23 and 24. FIG. 23 is a plan view of a protrusion portion 15 of a second die piece 13 according to Embodiment 2, corresponding to FIG. 17. FIG. 24 is an enlarged view of a region designated by X in FIG. 23, corresponding to FIG. 18. Note that in FIGS. 23 and 24, the same portions as those in Embodiment 1 are assigned the same reference numerals as those in Embodiment 1.

As shown in FIG. 23, in Embodiment 2, the top end surface 20 of the protrusion portion 15 has protrusion-side curvature changing portions 33P at positions adjacent to the protrusion-side concave portions 32. In Embodiment 2, the sign of curvature of the top end surface 20 changes at a boundary portion in the protrusion-side curvature changing portion 33P with respect to the protrusion-side concave portion 32 as with Embodiment 1. Further, in Embodiment 2, as shown in FIG. 24, the boundary portion where the sign of curvature of the top end surface 20 changes forms a flat surface portion (the portion designated by S in FIG. 24). When the top end surface 20 is seen in a plan view and considered as a curve, the flat surface portion S is illustrated as a linear portion as shown in FIG. 24. Thus, when the top end surface 20 is seen in a plan view and considered as a curve, the portion where the sign of curvature of the top end surface 20 changes may be not a single point (inflection point) but a region (linear portion) having a certain width.

Although Embodiment 2 is different from Embodiment 1 in the above point, the remaining configuration is the same as Embodiment 1 and is therefore not further described.

Aside from that, in Embodiment 1, the sign of curvature of the bottom wall surface 18 changes at the boundary portion in the recess-side curvature changing portion 27 with respect to the recess-side concave portion 26, and the boundary portion where the sign of curvature of the bottom wall surface 18 changes is the end position of the recess-side curve portion 28 on the side adjacent to the recess-side concave portion 26 (that is, the recess-side changing position 30). When the bottom wall surface 18 is seen in a plan view and considered as a curve, the recess-side changing position 30 corresponds to a single point (inflection point) on the curve; however, the same way of thinking as above is applied here, and the portion where the sign of curvature of the bottom wall surface 18 changes may be a region (linear portion in a plan view) having a certain width.

Configuration of Crimping Die According to Embodiment 3

In Embodiment 1, the sign of curvature of the bottom wall surface 18 changes at the boundary portion in the recess-side curvature changing portion 27 with respect to the recess-side concave portion 26. Further, in Embodiment 1, the sign of curvature of the top end surface 20 changes at the boundary portion in the protrusion-side curvature changing portion 33 with respect to the protrusion-side concave portion 32. However, in regard to this configuration, another embodiment (hereinafter called "Embodiment 3") different from Embodiment 1 is also possible.

Figure 25:
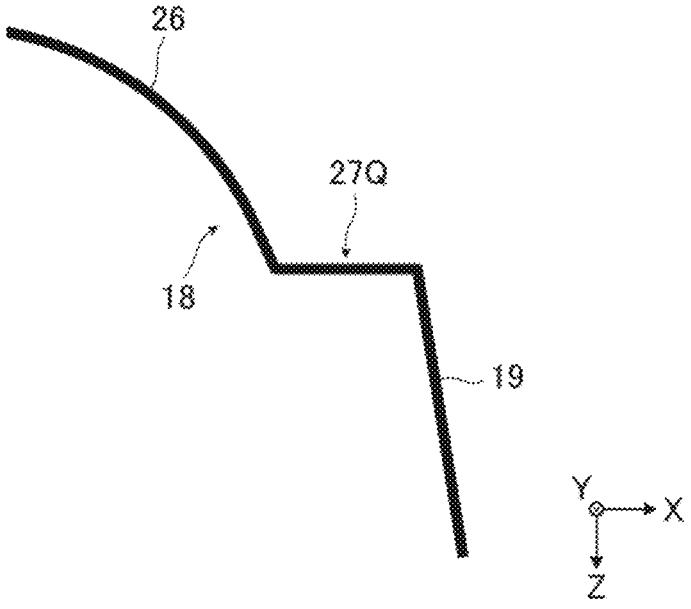
FIG. 25 is an enlarged plan view of a recess-side curvature changing portion according to Embodiment 3.
Figure 26:
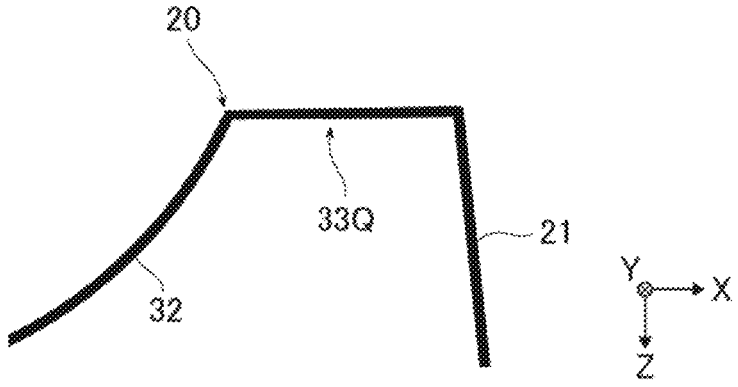
FIG. 26 is an enlarged plan view of a protrusion-side curvature changing portion according to Embodiment 3.

A configuration according to Embodiment 3 is described with reference to FIGS. 25 and 26. FIG. 25 is an enlarged plan view of a recess-side curvature changing portion 27Q according to Embodiment 3, corresponding to FIG. 16. FIG. 26 is an enlarged plan view of a protrusion-side curvature changing portion 33Q according to Embodiment 3, corresponding to FIG. 18. Note that in FIGS. 25 and 26, the same portions as those in Embodiment 1 are assigned the same reference numerals as those in Embodiment 1.

The recess-side curvature changing portion 27Q according to Embodiment 3 is not curved (i.e., the sign of curvature thereof cannot be defined), forms a flat surface intersecting the recess-side lateral end surface 19, and in the configuration shown in FIG. 25, extends along an XY plane. Similarly, the protrusion-side curvature changing portion 33Q is not curved (i.e., the sign of curvature thereof cannot be defined), forms a flat surface intersecting the protrusion-side lateral end surface 21, and in the configuration shown in FIG. 26, extends along an XY plane.

Although Embodiment 3 is different from Embodiment 1 in the above point, the remaining configuration is the same as Embodiment 1 and is therefore not further described.

Even with the recess-side curvature changing portion 27Q and the protrusion-side curvature changing portion 33Q according to Embodiment 3 described above, it is possible to prevent a material part of the crimp portion 6 from being forced out from the point pressed with the recess-side projection portion 25 or the protrusion-side projection portion 31 toward the lateral sides (in the X direction) at crimping, thus suppressing unsuitable deformation of the crimp portion 6.

Configuration of Crimping Die According to Embodiment 4

In Embodiment 1, the top of the recess-side curve portion 28 of the recess-side curvature changing portion 27 coincides with the top of the recess-side projection portion 25 in position in the Z direction (see FIG. 15). Further, in Embodiment 1, the top of the protrusion-side curve portion 34 of the protrusion-side curvature changing portion 33 coincides with the top of the protrusion-side projection portion 31 in position in the Z direction (see FIG. 17). However, in regard to this configuration, another embodiment (hereinafter called "Embodiment 4") different from Embodiment 1 is also possible.

Figure 27:
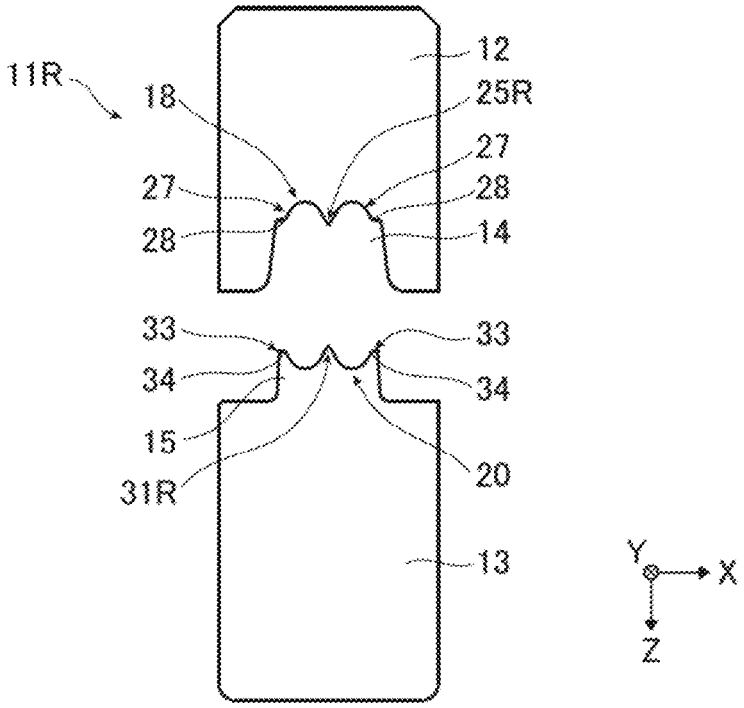
FIG. 27 is a plan view of a crimping die according to a first example of Embodiment 4.
Figure 28:
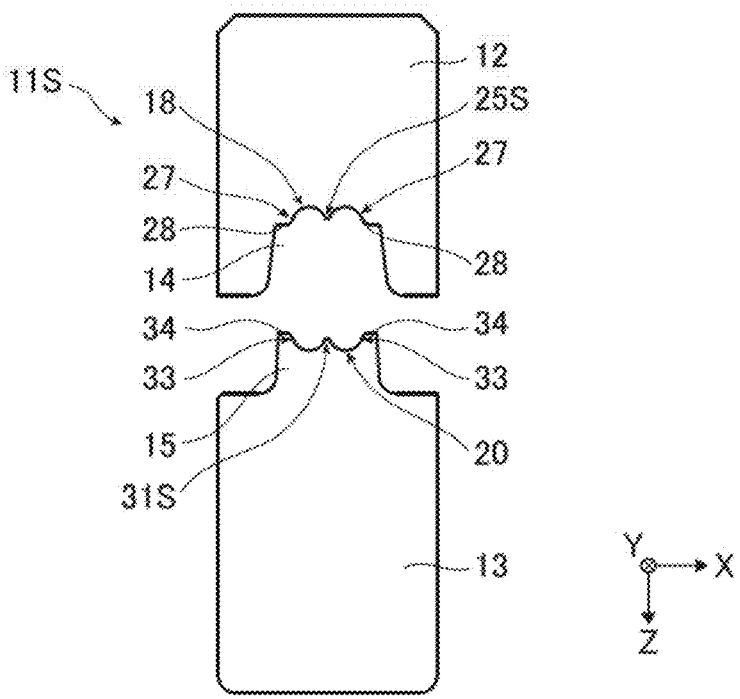
FIG. 28 is a plan view of a crimping die according to a second example of Embodiment 4.

A configuration according to Embodiment 4 is described with reference to FIGS. 27 and 28. FIG. 27 is a plan view of a crimping die 11R according to a first example of Embodiment 4. FIG. 28 is a plan view of a crimping die 11S according to a second example of Embodiment 4. Note that in FIGS. 27 and 28, the same portions as those in Embodiment 1 are assigned the same reference numerals as those in Embodiment 1.

In Embodiment 4, as shown in FIGS. 27 and 28, the top of each recess-side curve portion 28 is different from the top of a recess-side projection portion 25R in position in the Z direction. Similarly, in Embodiment 4, the top of each protrusion-side curve portion 34 is different from the top of a protrusion-side projection portion 31R in position in the Z direction.

Specifically, as shown in FIG. 27, the recess-side projection portion 25R may be higher than the recess-side curve portions 28 in the Z direction. That is, the recess-side projection portion 25R may project beyond the tops of the recess-side curve portions 28 in its projecting direction; in other words, the top of the recess-side projection portion 25R may be situated on the +Z side of the tops of the recess-side curve portions 28. Further, as shown in the same drawing, the protrusion-side projection portion 31R may be higher than the protrusion-side curve portions 34 in the Z direction. That is, the protrusion-side projection portion 31R may project beyond the tops of the protrusion-side curve portions 34 in its projecting direction; in other words, the top of the protrusion-side projection portion 31R may be situated on the −Z side of the tops of the protrusion-side curve portions 34. The recess-side projection portion 25R and the protrusion-side projection portion 31R shown in FIG. 27 each have flat surface portions (linear portions in a plan view) in their base portions.

Conversely, as shown in FIG. 28, a recess-side projection portion 25S may be lower than the recess-side curve portions 28 in the Z direction. That is, the top of the recess-side projection portion 25S may be situated on the −Z side of the tops of the recess-side curve portions 28. Further, as shown in the same drawing, a protrusion-side projection portion 31S may be lower than the protrusion-side curve portions 34 in the Z direction. That is, the top of the protrusion-side projection portion 31S may be situated on the +Z side of the tops of the protrusion-side curve portions 34.

As described above, the shape of the crimp portion 6 after crimping, more specifically, the depth of the narrowed portion can be adjusted by adjusting the positions of the tops of the recess-side projection portion 25R, 25S and the protrusion-side projection portion 31R, 31S.

Although Embodiment 4 is different from Embodiment 1 in the above point, the remaining configuration is the same as Embodiment 1 and is therefore not further described.

Configuration of Crimping Die According to Embodiment 5

In Embodiment 1, one recess-side projection portion 25 is provided in the middle portion of the bottom wall surface 18 of the recess portion 14, and one protrusion-side projection portion 31 is provided in the middle portion of the top end surface 20 of the protrusion portion 15. However, in regard to this configuration, another embodiment (hereinafter called "Embodiment 5") different from Embodiment 1 is also possible.

Figure 29:
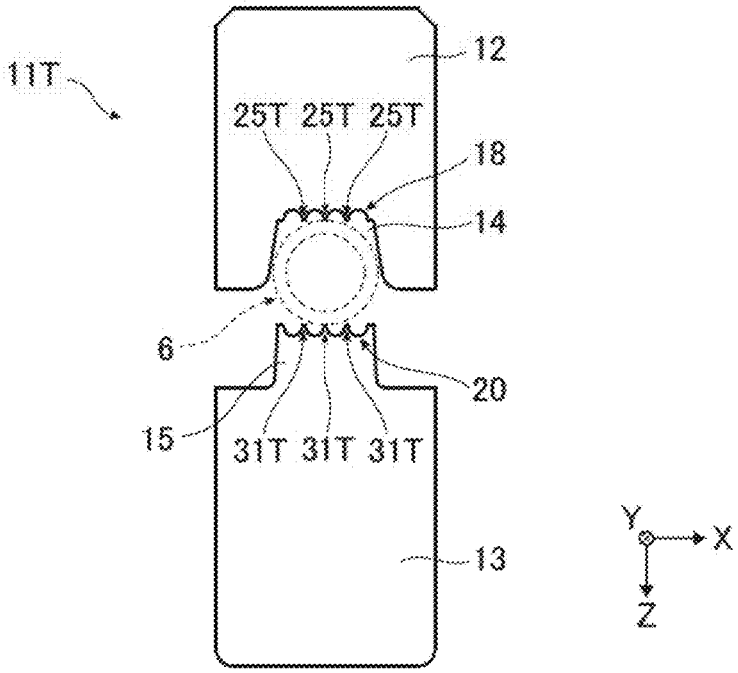
FIG. 29 is a plan view of a crimping die according to a first example of Embodiment 5.
Figure 30:
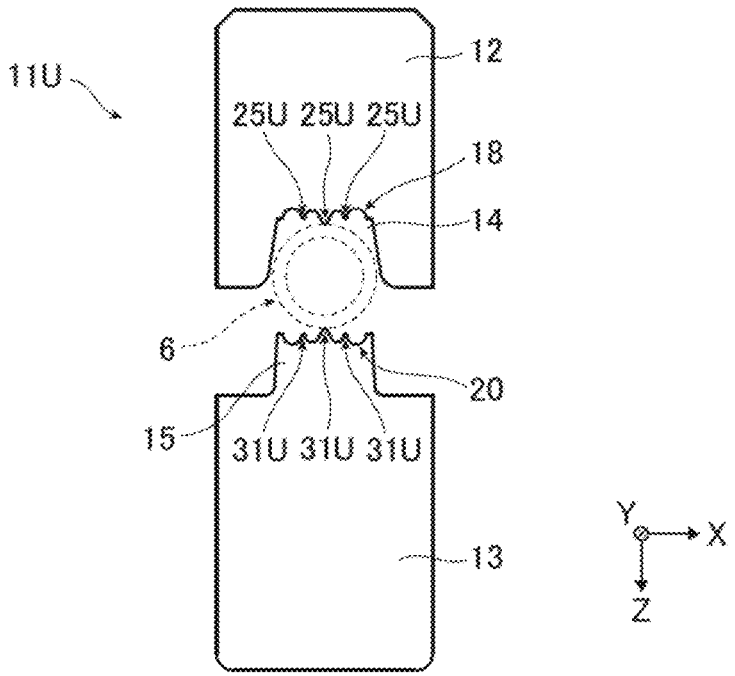
FIG. 30 is a plan view of a crimping die according to a second example of Embodiment 5.
Figure 31:
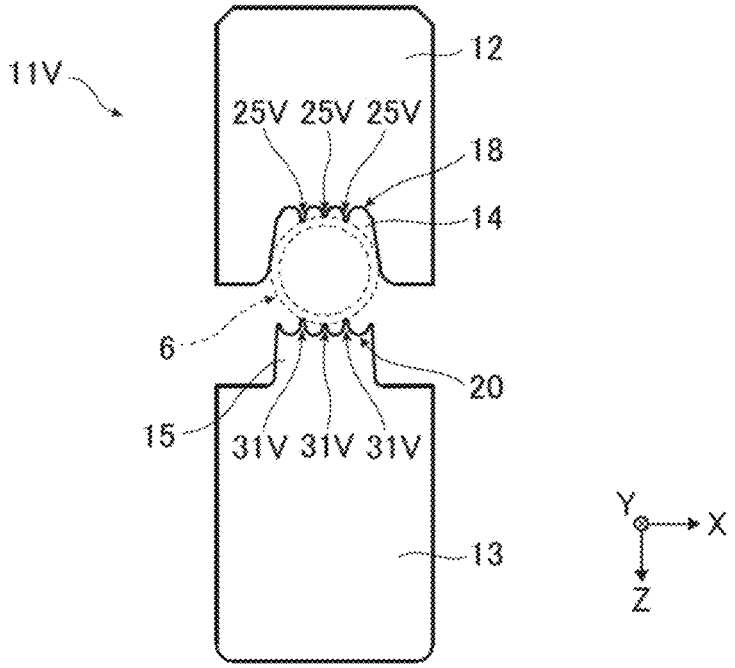
FIG. 31 is a plan view of a crimping die according to a third example of Embodiment 5.

A configuration according to Embodiment 5 is described with reference to FIGS. 29 to 31. FIG. 29 is a plan view of a crimping die 11T according to a first example of Embodiment 5. FIG. 30 is a plan view of a crimping die 11U according to a second example of Embodiment 5. FIG. 31 is a plan view of a crimping die 11V according to a third example of Embodiment 5. Note that in FIGS. 29 to 31, the same portions as those in Embodiment 1 are assigned the same reference numerals as those in Embodiment 1. For ease of understanding of the description, the crimp portion 6 immediately before crimping is illustrated by dashed line in FIGS. 29 to 31.

In Embodiment 5, as shown in FIGS. 29 to 31, a plurality of recess-side projection portions 25T, 25U, 25V are provided in a middle portion of the bottom wall surface 18 of the recess portion 14. Similarly, a plurality of protrusion-side projection portions 31T, 31U, 31V are provided in a middle portion of the top end surface 20 of the protrusion portion 15. This configuration makes it possible to increase crimped places (swaged places) in the crimp portion 6, thereby crimping the crimp portion 6 onto the conductive wires 3 lying in the crimp portion 6 more firmly. At the same time, the die shape is more complicated than that in Embodiment 1, and this leads to increased work in the manufacture of the die.

The number of the recess-side projection portions 25T, 25U, 25V and the number of the protrusion-side projection portions 31T, 31U, 31V may be arbitrarily determined and are preferably the same as each other for the purpose of compressing and deforming the crimp portion 6 into a symmetric shape.

The tops of the recess-side projection portions 25T may coincide in position in the Z direction, and the tops of the protrusion-side projection portions 31T may coincide in position in the Z direction, as in the configuration shown in FIG. 29; however, the invention is not limited thereto, and the tops may be situated in different positions in the Z direction. For instance, as in the configuration shown in FIG. 30, among the recess-side projection portions 25U, the top of the recess-side projection portion 25U closer to the middle of the bottom wall surface 18 may be situated farther on the +Z side (i.e., may be higher). Similarly, among the protrusion-side projection portions 31U, the top of the protrusion-side projection portion 31U closer to the middle of the top end surface 20 may be situated farther on the −Z side (i.e., may be higher).

Conversely, as in the configuration shown in FIG. 31, among the recess-side projection portions 25V, the top of the recess-side projection portion 25V farther apart from the middle of the bottom wall surface 18 may be situated farther on the +Z side (i.e., may be higher). Similarly, among the protrusion-side projection portions 31V, the top of the protrusion-side projection portion 31V farther apart from the middle of the top end surface 20 may be situated farther on the −Z side (i.e., may be higher).

Although Embodiment 5 is different from Embodiment 1 in the above point, the remaining configuration is the same as Embodiment 1 and is therefore not further described.

What is claimed is:

1. A crimping die for use in crimping a crimp portion of tubular shape included in a terminal fitting onto a conductive wire lying in the crimp portion, comprising:

a first die piece having a recess portion and a second die piece having a protrusion portion that enters the recess portion, an inner wall surface of the recess portion has a bottom wall surface and a pair of recess-side lateral end surfaces separately situated on opposite sides of the bottom wall surface, an outer surface of the protrusion portion has a top end surface and a pair of protrusion-side lateral end surfaces separately situated on opposite sides of the top end surface, the crimping die presses the crimp portion having the conductive wire therein with the inner wall surface and the outer surface to crimp the crimp portion onto the conductive wire, the bottom wall surface has a recess-side projection portion projecting toward an opening of the recess portion, a recess-side concave portion adjoining the recess-side projection portion, and a recess-side curvature changing portion between the recess-side concave portion and one of the pair of recess-side lateral end surfaces, the top end surface has a protrusion-side projection portion projecting in a same direction as a direction in which the protrusion portion protrudes, a protrusion-side concave portion adjoining the protrusion-side projection portion, and a protrusion-side curvature changing portion between the protrusion-side concave portion and one of the pair of protrusion-side lateral end surfaces, a sign of curvature of the bottom wall surface changes at a boundary portion in the recess-side curvature changing portion with respect to the recess-side concave portion, a sign of curvature of the top end surface changes at a boundary portion in the protrusion-side curvature changing portion with respect to the protrusion-side concave portion, each of the recess-side projection portion and the protrusion-side projection portion is curved at a mountain-like shape with a rounded top, each of the recess-side concave portion and the protrusion-side concave portion is curved in a concave shape, the recess-side curvature changing portion has a recess-side curve portion that is curved at a position adjacent to the recess-side concave portion and a recess-side connecting portion that interconnects the recess-side curve portion and one of the pair of recess-side lateral end surfaces, the protrusion-side curvature changing portion has a protrusion-side curve portion that is curved at a position adjacent to the protrusion-side concave portion and a protrusion-side connecting portion that interconnects the protrusion-side curve portion and one of the pair of protrusion-side lateral end surfaces, and wherein in a state where the bottom wall surface and the top end surface face each other, the recess-side projection portion, the recess-side concave portion and the recess-side curve portion have a mirror image relationship with the protrusion-side projection portion, the protrusion-side concave portion and the protrusion-side curve portion.

2. The crimping die according to claim 1, wherein each of the bottom wall surface and the top end surface has a lateral width smaller than an outer diameter of the crimp portion.

3. The crimping die according to claim 2, wherein each of the pair of recess-side lateral end surfaces of the inner wall surface is inclined such that a distance between the pair of recess-side lateral end surfaces increases as advancing toward the opening, and each of the pair of protrusion-side lateral end surfaces of the outer surface is inclined such that a distance between the pair of protrusion-side lateral end surfaces decreases as advancing toward a tip of the protrusion portion.

4. The crimping die according to claim 1, wherein the recess-side projection portion extends along a depth direction of the first die piece, and the protrusion-side projection portion extends along a depth direction of the second die piece.

5. The crimping die according to claim 1, wherein the bottom wall surface has a symmetric shape with respect to a middle position of the bottom wall surface in a lateral width direction of the recess portion, and the top end surface has a symmetric shape with respect to a middle position of the top end surface in a lateral width direction of the protrusion portion.

6. A crimping equipment for crimping the crimp portion onto the conductive wire comprising the crimping die according to claim 1.

7. A crimping die for use in crimping a crimp portion of tubular shape included in a terminal fitting onto a conductive wire lying in the crimp portion, comprising:

a first die piece having a recess portion and a second die piece having a protrusion portion that enters the recess portion, an inner wall surface of the recess portion has a bottom wall surface and a pair of recess-side lateral end surfaces separately situated on opposite sides of the bottom wall surface, an outer surface of the protrusion portion has a top end surface and a pair of protrusion-side lateral end surfaces separately situated on opposite sides of the top end surface, the crimping die presses the crimp portion having the conductive wire therein with the inner wall surface and the outer surface to crimp the crimp portion onto the conductive wire, the bottom wall surface has a recess-side projection portion projecting toward an opening of the recess portion, a recess-side concave portion adjoining the recess-side projection portion, and a recess-side curvature changing portion between the recess-side concave portion and one of the pair of recess-side lateral end surfaces, the top end surface has a protrusion-side projection portion projecting in a same direction as a direction in which the protrusion portion protrudes, a protrusion-side concave portion adjoining the protrusion-side projection portion, and a protrusion-side curvature changing portion between the protrusion-side concave portion and one of the pair of protrusion-side lateral end surfaces, a sign of curvature of the bottom wall surface changes at a boundary portion in the recess-side curvature changing portion with respect to the recess-side concave portion, a sign of curvature of the top end surface changes at a boundary portion in the protrusion-side curvature changing portion with respect to the protrusion-side concave portion, each of the recess-side projection portion and the protrusion-side projection portion is curved at a mountain-like shape with a rounded top, each of the recess-side concave portion and the protrusion-side concave portion is curved in a concave shape, the recess-side curvature changing portion has a recess-side curve portion that is curved at a position adjacent to the recess-side concave portion and a recess-side connecting portion that interconnects the recess-side curve portion and one of the pair of recess-side lateral end surfaces, the protrusion-side curvature changing portion has a protrusion-side curve portion that is curved at a position adjacent to the protrusion-side concave portion and a protrusion-side connecting portion that interconnects the protrusion-side curve portion and one of the pair of protrusion-side lateral end surfaces, wherein a top of the recess-side projection portion coincides with a top of the recess-side curve portion in position in a direction in which the recess-side projection portion projects, and a top of the protrusion-side projection portion coincides with a top of the protrusion-side curve portion in position in a direction in which the protrusion-side projection portion projects.

8. A crimping die for use in crimping a crimp portion of tubular shape included in a terminal fitting onto a conductive wire lying in the crimp portion, comprising:

a first die piece having a recess portion and a second die piece having a protrusion portion that enters the recess portion, an inner wall surface of the recess portion has a bottom wall surface and a pair of recess-side lateral end surfaces separately situated on opposite sides of the bottom wall surface, an outer surface of the protrusion portion has a top end surface and a pair of protrusion-side lateral end surfaces separately situated on opposite sides of the top end surface, the crimping die presses the crimp portion having the conductive wire therein with the inner wall surface and the outer surface to crimp the crimp portion onto the conductive wire, the bottom wall surface has a recess-side projection portion projecting toward an opening of the recess portion, a recess-side concave portion adjoining the recess-side projection portion, and a recess-side curvature changing portion between the recess-side concave portion and one of the pair of recess-side lateral end surfaces, the top end surface has a protrusion-side projection portion projecting in a same direction as a direction in which the protrusion portion protrudes, a protrusion-side concave portion adjoining the protrusion-side projection portion, and a protrusion-side curvature changing portion between the protrusion-side concave portion and one of the pair of protrusion-side lateral end surfaces, a sign of curvature of the bottom wall surface changes at a boundary portion in the recess-side curvature changing portion with respect to the recess-side concave portion, a sign of curvature of the top end surface changes at a boundary portion in the protrusion-side curvature changing portion with respect to the protrusion-side concave portion, each of the recess-side projection portion and the protrusion-side projection portion is curved at a mountain-like shape with a rounded top, each of the recess-side concave portion and the protrusion-side concave portion is curved in a concave shape, the recess-side curvature changing portion has a recess-side curve portion that is curved at a position adjacent to the recess-side concave portion and a recess-side connecting portion that interconnects the recess-side curve portion and one of the pair of recess-side lateral end surfaces, the protrusion-side curvature changing portion has a protrusion-side curve portion that is curved at a position adjacent to the protrusion-side concave portion and a protrusion-side connecting portion that interconnects the protrusion-side curve portion and one of the pair of protrusion-side lateral end surfaces, wherein the recess-side projection portion projects beyond a top of the recess-side curve portion in a direction in which the recess-side projection portion projects, and the protrusion-side projection portion projects beyond a top of the protrusion-side curve portion in a direction in which the protrusion-side projection portion projects.

* * * * *